US010143340B2

(12) United States Patent
Allard et al.

(10) Patent No.: US 10,143,340 B2
(45) Date of Patent: Dec. 4, 2018

(54) DISPENSER ASSEMBLY AND RELATED METHODS

(71) Applicant: SCA Hygiene Products AB, Göteborg (SE)

(72) Inventors: Bryan Fitzgerald Allard, West Chester, PA (US); Michael Austin Dotsey, Chester Springs, PA (US); Noah Eberhard Dingler, Phoenixville, PA (US); Patrick Bryan Nolan, Royersford, PA (US)

(73) Assignee: ESSITY HYGIENE AND HEALTH AKTIEBOLAG, Göteborg (SE)

( * ) Notice: Subject to any disclaimer, the term of this patent is extended or adjusted under 35 U.S.C. 154(b) by 529 days.

(21) Appl. No.: 14/798,056

(22) Filed: Jul. 13, 2015

(65) Prior Publication Data

US 2016/0367088 A1 Dec. 22, 2016

Related U.S. Application Data

(60) Provisional application No. 62/180,693, filed on Jun. 17, 2015.

(51) Int. Cl.
*A47K 10/38* (2006.01)
*A47K 10/36* (2006.01)
(Continued)

(52) U.S. Cl.
CPC ..... *A47K 10/38* (2013.01); *A47K 10/32* (2013.01); *A47K 10/36* (2013.01);
(Continued)

(58) Field of Classification Search
CPC . A47K 10/38; A47K 10/32; A47K 2010/3233
(Continued)

(56) References Cited

U.S. PATENT DOCUMENTS 2,487,763 A * 11/1949 Patterson ..... A47K 10/22 242/598.3
2,626,761 A * 1/1953 Simpson ..... A47K 10/38 225/42

(Continued)

FOREIGN PATENT DOCUMENTS

JP 2007-289376 A 11/2007
JP 3155456 U 11/2009
WO WO 2008/041939 A1 4/2008

OTHER PUBLICATIONS

International Preliminary Report on Patentability dated Dec. 19, 2017 issued in related International patent application No. PCT/EP/2016/062478 (8 pages).

(Continued)

*Primary Examiner* — William E Dondero
*Assistant Examiner* — Mark K Buse
(74) *Attorney, Agent, or Firm* — Drinker Biddle & Reath LLP

(57) ABSTRACT

A paper product dispenser assembly has a hood that includes a hood coupling component, as well as a first rear housing member that is configured for selective coupling with the hood. The first rear housing member has a first coupling component that cooperates with the hood coupling component for releasably coupling the hood and the first rear housing member to one another. The first rear housing member and the hood jointly define a first housing that is adapted to hold a roll of paper product therein. A second rear housing member of the assembly is configured for selective coupling with the hood in place of the first rear housing member. The second rear housing member has a second coupling component that cooperates with the hood coupling component for releasably coupling the hood and the second rear housing member to one another.

28 Claims, 22 Drawing Sheets

(51) Int. Cl.
*A47K 10/32* (2006.01)
*A47K 10/40* (2006.01)

(52) U.S. Cl.
CPC ..... *A47K 10/3612* (2013.01); *A47K 10/3625* (2013.01); *A47K 10/3637* (2013.01); *A47K 10/3827* (2013.01); *A47K 10/3836* (2013.01); *A47K 10/40* (2013.01); *A47K 2010/3233* (2013.01); *A47K 2010/3246* (2013.01); *A47K 2010/3668* (2013.01)

(58) Field of Classification Search
USPC ..... 242/596.8
See application file for complete search history.

(56) References Cited

U.S. PATENT DOCUMENTS 3,494,518 A * 2/1970 Goss ..... A47K 10/38 225/34
3,620,404 A * 11/1971 Joseph ..... E04F 19/08 174/503
4,444,359 A * 4/1984 Butler ..... A47K 10/38 225/51
5,154,496 A * 10/1992 Campbell ..... A47K 10/32 221/199
6,082,664 A * 7/2000 Phelps ..... A47K 10/38 242/560
6,202,956 B1 * 3/2001 Grasso ..... A47K 10/3836 242/560
7,011,271 B2 * 3/2006 Walters ..... A47K 10/38 242/596.8
7,984,872 B2 * 7/2011 Kuehnennan ..... A47K 10/36 242/390.9
7,997,522 B2 * 8/2011 Titas ..... A47K 10/3818 221/33
9,010,602 B2 * 4/2015 Budz ..... A47K 10/36 225/16
9,572,460 B2 * 2/2017 Petocchi ..... A47K 10/3612
9,770,143 B2 * 9/2017 Corley ..... A47K 10/38
2003/0146337 A1 * 8/2003 Moody ..... A47K 10/38 242/594
2003/0213809 A1 * 11/2003 Weigen ..... A47K 10/38 221/2
2005/0051663 A1 * 3/2005 Walters ..... A47K 10/38 242/597.8
2005/0156080 A1 * 7/2005 Lugo ..... A47K 10/38 242/560.2
2006/0102769 A1 * 5/2006 Wieser ..... A47K 10/38 242/560
2006/0138274 A1 * 6/2006 Goeking ..... A47K 10/36 242/564.4
2007/0023565 A1 * 2/2007 Babikian ..... A47K 10/38 242/598.6
2007/0158491 A1 7/2007 Moore
2008/0116314 A1 5/2008 Elliott et al.
2008/0238275 A1 10/2008 Andersson et al.
2010/0050537 A1 * 3/2010 Murray ..... H02G 3/121 52/27
2011/0011890 A1 * 1/2011 Rosenkranz ..... A47K 5/12 222/153.03
2011/0210198 A1 * 9/2011 Case ..... A47K 10/38 242/598
2012/0036975 A1 2/2012 Jokitalo et al.
2012/0111987 A1 * 5/2012 Phelps ..... A47K 10/40 242/560
2012/0211587 A1 * 8/2012 Caldwell ..... B65H 49/26 242/599.1
2015/0374181 A1 * 12/2015 Morand ..... A47K 10/38 242/423

OTHER PUBLICATIONS

First Examination Report dated May 10, 2018 issued in corresponding New Zealand patent application No. 737547.
International Search Report and Written Opinion dated Aug. 19, 2016 issued in related International patent application No. PCT/EP2016/062478 (13 pages).

* cited by examiner

DISPENSER ASSEMBLY AND RELATED METHODS

CROSS-REFERENCE TO RELATED APPLICATIONS

The present application claims the filing date benefit of U.S. Provisional Patent Application No. 62/180,693, titled DISPENSER ASSEMBLY AND RELATED METHODS, filed Jun. 17, 2015, the contents of which are hereby expressly incorporated by reference herein.

TECHNICAL FIELD

The present disclosure is generally related to systems and methods for dispensing substrate materials and, more specifically, for dispensing paper product provided in roll form.

BACKGROUND

Manufacturers of apparatus used to dispense substrates, such as paper product from a roll, often face logistical challenges when attempting to meet the needs of different kinds of customers. For example, manufacturers may be required to make, administer, distribute, and maintain dispensers that require the user to manually pull the end of a paper web, as well as hand-free dispensers that automatically dispense paper when a hand is waved in front of a sensor in the dispenser. Likewise, manufacturers often need to accommodate the needs of customers that prefer a dispenser to be mounted on a wall or counter, as well as the needs of those that prefer the dispenser to be at least partially recessed into a wall. The resulting large assortment of dispensers manufacturers are required to offer, in turn, results in the manufacturers having to make a very large assortment of components for each type of dispenser, both for the initial manufacture of each of the dispensers, as well as to offer as replacement parts for maintenance purposes. The complexity in administering large sets of components and a large assortment of dispensers often represents a major hindrance.

In addition to the above, customers often change their dispenser preferences, and require the manufacturers or distributors of dispensers to take on the task of substituting one type of dispenser for another. For example, and without limitation, a customer may require that a manual-type dispenser be replaced with a hands-free type dispenser. This task is often complex and therefore costly. Another example is provided by a customer that wishes for a manual or hands-free dispenser to be installed as a recessed dispenser, using the recessed frame of an existing recessed folded-towel dispenser.

To protect for such scenario, manufacturers are required to make and stock different types of additional dispenser components, to be used in the installation of the new dispenser, depending on the dimensions and shape of the existing recessed folded-towel dispenser. The resulting installation is typically a complex, costly process and results in the newly-installed dispenser being aesthetically undesirable. For example, the newly-installed dispenser may be offset, rather than centered, relative to the recessed frame behind.

It would be desirable, therefore, to have dispenser systems and related methods that address these and other drawbacks of conventional paper product dispensers.

SUMMARY

In one embodiment, a paper product dispenser assembly is provided. The assembly has a hood that includes a hood coupling component, as well as a first rear housing member that is configured for selective coupling with the hood. The first rear housing member has a first coupling component that cooperates with the hood coupling component for releasably coupling the hood and the first rear housing member to one another. The first rear housing member and the hood jointly define a first housing that is adapted to hold a roll of paper product therein. A second rear housing member of the assembly is configured for selective coupling with the hood in place of the first rear housing member.

The second rear housing member has a second coupling component that cooperates with the hood coupling component for releasably coupling the hood and the second rear housing member to one another. The second rear housing member and the hood jointly define a second housing that is adapted to hold a roll of paper product therein. The assembly also includes a dispensing member that is at least partially disposed within the first housing or the second housing, and which is adapted to selectively dispense the paper product respectively from within the first housing or from within the second housing.

The first rear housing member has a first pair of oppositely located side walls, a first rear wall extending between the first pair of side walls, and at least one resilient side tab that extends outwardly from one of the first pair of side walls and configured to engage one or both external side walls of a recessed space for mounting the first rear housing member within the recessed space. The first rear housing member further includes a front opening, as well as a front panel that surrounds the front opening. The second rear housing member has a second pair of oppositely located side walls, as well as a second rear wall that extends between the second pair of side walls, and a mounting feature on the second rear wall for mounting the second rear housing member on an external wall.

In specific embodiments, selective releasable coupling between the hood and the first rear housing member, and also between the hood and the second rear housing member, is free of fasteners. Additionally or alternatively, the hood coupling component may include a male coupling component, and each of the first and second coupling components may include a respective female coupling component that is adapted to receive the male component therein for selective releasable coupling between the hood and the first rear housing member, and between the hood and the second rear housing member. The male coupling component may further include a resilient element for snap-coupling between the male coupling component and a female coupling component.

In specific embodiments, snap-coupling includes the hood being locked in place relative to the first rear housing member or relative to the second rear housing member. The assembly may further include a pair of roll support arms, each configured to support an end of a roll of paper product, with the first and second rear housing members including a respective pair of roll support couplers, with each of the roll support couplers being configured for selective releasable coupling with one of the roll support arms. One or more of the roll support couplers may include a female element, and one or more of the roll support arms may include a male element that is configured to be received within the female element.

Coupling between the roll support couplers and the roll support arms may be free of fasteners. Additionally or alternatively, each of the roll support arms may include an arm resilient element that is configured to flex upon coupling engagement between one of the roll support arms and a respective one of the roll support couplers. The arm resilient element may be configured to lock the roll support arm that includes the resilient element, relative to the roll support coupler to which the roll support arm is coupled. In specific embodiments, one or more of the roll support arms has a guide element that is configured to restrict the number of possible orientations of the roll support arm for coupling with one of the roll support couplers.

The dispensing member may include a paper feed bar, and each of the first rear housing member and the second rear housing member may include a top wall and an oppositely disposed bottom wall, both extending between the pair of side walls of the first rear housing member and between the second pair of side walls of the second rear housing member, respectively, with the bottom wall including a notch that defines an opening in the bottom wall that is adapted to allow the paper feed bar to extend there through and to an exterior of the first or second housing.

Additionally, the assembly may include a bottom console that is configured for selective releasable coupling with the bottom wall, with the bottom console including a protruding portion that is configured to engage the notch so as to close the opening in the bottom wall. In specific embodiments, the at least one resilient side tab includes a fastener opening that is adapted to receive a fastener there through, for mounting the first rear housing member to one or both external side walls of the recessed space. Additionally or alternatively, at least one of the first pair of side walls may include an installation guide slot that is adapted to permit viewing, from an interior of the first rear housing member, of an installation mark on an adjacent one of the external side walls.

The first rear housing member may include a bottom wall extending between the first pair of side walls, and a bottom plate adjacent and spaced from the bottom wall, with the bottom plate having first and second bottom plate members that are slidable relative to one another, so as to permit adjustment of a depth dimension of the bottom plate. Additionally or alternatively, each of the first and second rear walls of the first and second rear housing members, respectively, may include a wire hole that is adapted to receive a wire there through, for providing power to the dispensing member.

The dispensing member may include a sensor and a processor, with the sensor being configured to sense the presence of a human body adjacent the sensor, and with the processor being configured to cause the dispensing member to dispense paper product in response to sensing by the sensor. The dispensing member may include a paper feed bar that is manually actuatable to cause the dispensing of paper product upon selective actuation of the paper feed bar. In specific embodiments, the hood has a metallic outer surface. Additionally or alternatively, the first rear housing member may include a front opening and a metallic front panel that surrounds the front opening. Additionally or alternatively also, the second rear housing member may have a metallic outer surface.

In another embodiment, a paper product dispenser assembly includes a hood that has a metallic outer surface and a male coupling component. A first rear housing member of the assembly is configured for selective coupling with the hood, with the first rear housing member having a first female coupling component that cooperates with the male coupling component for releasable, fastener-free coupling between the hood and the first rear housing member. The first rear housing member and the hood jointly define a first housing that is adapted to hold a roll of paper product therein.

The assembly also includes a second rear housing member that has a metallic outer surface, and which is configured for selective coupling with the hood in place of the first rear housing member. The second rear housing member has a second female coupling component that cooperates with the male coupling component for releasable coupling between the hood and the second rear housing member. The second rear housing member and the hood jointly define a second housing that is adapted to hold a roll of paper product therein. A dispensing member of the assembly is at least partially disposed within the first housing or within the second housing, and is adapted to selectively dispense paper product respectively from within the first housing or from within the second housing.

The first rear housing member has a first pair of oppositely located side walls, a first rear wall that extends between the first pair of side walls, and at least one resilient side tab that extends outwardly from each of the first pair of side walls. The resilient side tabs are configured for engagement with the external side walls of a recessed space for mounting the first rear housing member within the recessed space. The first rear housing member further includes a front opening and a metallic front panel that surrounds the front opening. The second rear housing member has a second pair of oppositely located side walls, a second rear wall that extends between the second pair of side walls, and at least one fastener opening that extends through the second rear wall for mounting the second rear housing member on an external wall.

In yet another embodiment, a paper product dispenser assembly is provided that includes a hood having hood coupling means, and a first rear housing member that is configured for selective coupling with the hood. The first rear housing member has first coupling means that cooperate with the hood coupling means for releasably coupling the hood and the first rear housing member to one another, with the first rear housing member and the hood jointly defining a first housing that is adapted to hold a roll of paper product therein. A second rear housing member of the assembly is configured for selective coupling with the hood in place of the first rear housing member.

The second rear housing member has second coupling means that cooperate with the hood coupling means for releasably coupling the hood and the second rear housing member to one another. The second rear housing member and the hood jointly define a second housing that is adapted to hold a roll of paper product therein. The assembly also includes means at least partially disposed within the first housing or within the second housing for selectively dispensing the paper product respectively from within the first housing or from within the second housing. The first rear housing member has a first pair of oppositely located side walls, a first rear wall that extends between the first pair of side walls, and resilient means extending outwardly from at least one of the first pair of side walls and configured to engage one or both external side walls of a recessed space for mounting the first rear housing member within the recessed space.

The first rear housing member also includes a front opening, as well as a front panel that surrounds the front opening. The second rear housing member has a second pair of oppositely located side walls, a second rear wall that extends between the second pair of side walls, and mounting means on the second rear wall for mounting the second rear housing member on an external wall. The hood coupling means and the first coupling means, in specific embodiments, define a fastener-free coupling between the hood and the first rear housing member. Additionally or alternatively, the hood coupling means and the second coupling means may define a fastener-free coupling between the hood and the second rear housing member.

In another embodiment a paper product dispenser is provided that includes a hood having a hood coupling component. A rear housing member of the dispenser is configured for coupling with the hood, with the rear housing member having a rear housing member coupling component that cooperates with the hood coupling component for releasably coupling the hood and the rear housing member to one another. The rear housing member and the hood jointly define a housing that is adapted to hold a roll of paper product therein. The rear housing member has a pair of oppositely located side walls, a rear wall that extends between the pair of side walls, and at least one pair of resilient side tabs extending outwardly from the pair of side walls.

The resilient side tabs are configured for engagement with the external side walls of a recessed space for mounting the rear housing member within the recessed space. A bottom plate extends between the first pair of side walls. The dispenser also includes a dispensing member that is at least partially disposed within the housing and which is adapted to selectively dispense the paper product from within the housing. The bottom plate has first and second bottom plate members that are slidable relative to one another, so as to permit adjustment of a depth dimension of the bottom plate.

The rear housing member, in specific embodiments, includes a front opening and a front panel that surrounds the front opening. The front panel, if present, may be metallic. Additionally or alternatively, each of the resilient side tabs may include a fastener opening that is adapted to receive a fastener there through for mounting the rear housing member to the external side walls. In some embodiments, at least one of the pair of side walls includes an installation guide slot that is adapted to permit viewing, from an interior of the rear housing member, of an installation mark adjacent one of the external side walls.

The rear wall, in specific embodiments, includes a wire hole that is adapted to receive a wire there through. The dispenser may further include a bottom wall that extends between the pair of side walls and which is disposed in an interior of the rear housing member. The bottom wall includes a notch that defines an opening in the bottom wall that is configured to permit extension there through of a portion of the dispensing member. The dispenser may also include a bottom console that is configured for releasable coupling with the bottom wall, with the bottom console having a protruding portion that is adapted to engage the notch and thereby close the opening in the bottom wall.

The bottom console may be configured for fastener-free coupling with the bottom wall. In some embodiments, the releasable coupling between the hood and the rear housing member is fastener-free. In those or other embodiments, the hood coupling component or the rear housing member coupling component includes a male component, and the other of the hood coupling component or the rear housing member coupling component includes a female component, with the female component being configured to receive therein the male component. The male component may include a resilient element for snap-coupling between the male component and the female component. Snap-coupling between the male component and the female component may further include the hood being locked in place relative to the rear housing member.

The dispenser may additionally include a pair of roll support arms, each configured to support an end of a roll of paper product. The rear housing member may include a pair of roll support couplers, each configured for selective releasable coupling with one of the roll support arms. Each of the pair of roll support couplers may include a female element and each of the pair of roll support arms may include a male element that is configured to be received within the female element.

Coupling between each of the pair of roll support couplers and one of the pair of roll support arms may be free of fasteners. Further, in specific embodiments, each of the pair of roll support arms includes an arm resilient element that is configured to flex upon coupling engagement between one of the roll support arms and a respective one of the roll support couplers. The arm resilient element may be configured to lock the roll support arm that includes the resilient element, relative to a roll support coupler to which the roll support arm is coupled. Additionally or alternatively, each of the pair of roll support arms may have a guide element that is configured to restrict the number of possible orientations of that roll support arm for coupling with one of the roll support couplers.

In another embodiment a paper product dispenser is provided that includes a hood having hood coupling means. The dispenser also includes a rear housing member that is configured for coupling with said hood, with the rear housing member having rear housing member coupling means that cooperate with the hood coupling means for releasably coupling the hood and the rear housing member to one another. The rear housing member and the hood jointly define a housing that is adapted to hold a roll of paper product therein.

The rear housing member has a pair of oppositely located side walls, a rear wall that extends between the pair of side walls, and resilient means that extend outwardly from at least one of the side walls and configured to engage one or both external side walls of a recessed space for mounting the rear housing member within the recessed space. A bottom plate extends between the pair of side walls, and a dispensing member is at least partially disposed within the housing and is adapted to selectively dispense the paper product from within the housing. The bottom plate has first and second bottom plate members that are slidable relative to one another, so as to permit adjustment of a depth dimension of the bottom plate.

In still another embodiment, a paper product dispenser includes a hood having a hood coupling component, and a rear housing member that is configured for coupling with the hood. The rear housing member has a rear housing member coupling component that cooperates with the hood coupling component for releasably coupling the hood and the rear housing member to one another. The rear housing member and the hood jointly define a housing that is adapted to hold a roll of paper product therein. The rear housing member has a pair of oppositely located side walls, a rear wall that extends between the pair of side walls, and a bottom wall that extends between the pair of side walls.

A dispensing member of the dispenser is at least partially disposed within the housing, and is adapted to selectively dispense the paper product from within the housing. The dispenser also includes a bottom console that is configured for selective releasable coupling with the bottom wall, with the bottom wall including a notch that defines an opening in the bottom wall that is adapted to allow a portion of the dispensing member to extend there through and out of the housing. The bottom console includes a protruding portion that is configured to engage the notch so as to close the opening in the bottom wall.

The rear housing member may include a front panel that surrounds a front opening of the rear housing member. The front panel may be metallic. In specific embodiments, each of the pair of side walls includes a resilient side tab having a fastener opening that is adapted to receive a fastener there through for mounting the rear housing member to the external side walls of a recessed space. Additionally or alternatively, at least one of the pair of side walls includes an installation guide slot that is adapted to permit viewing, from an interior of the rear housing member, of an installation mark on an adjacent one of the external side walls of a recessed space.

The rear wall, in particular embodiments, includes a wire hole that is adapted to receive a wire there through. The bottom console may be configured for fastener-free coupling with the bottom wall. In specific embodiments, releasable coupling between the hood and the rear housing member is fastener-free. In specific embodiments, the hood coupling component or the rear housing member coupling component includes a male component and the other of the hood coupling component or the rear housing member coupling component includes a female component, with the female component being configured to receive therein the male component.

The male component may include a resilient element for snap-coupling between the male component and the female component. Snap-coupling between the male component and the female component, in some embodiments, includes the hood being locked in place relative to the rear housing member. The dispenser may also include a pair of roll support arms, each configured to support an end of a roll of paper product, with the rear housing member including a pair of roll support couplers, each configured for selective releasable coupling with one the pair of roll support arms.

In some embodiments, each of the pair of roll support couplers includes a female element, and each of the pair of roll support arms includes a male element that is configured to be received within female element. Coupling between each of the pair of roll support couplers and one of the pair of roll support arms may be free of fasteners. Each of the pair of roll support arms may include an arm resilient element that is configured to flex upon coupling engagement between one of the roll support arms and a respective one of the pair of roll support couplers.

Additionally or alternatively, the arm resilient element may be configured to lock the roll support arm that includes the resilient element, relative to the roll support coupler to which the roll support arm is coupled. In specific embodiments, each of the pair of roll support arms has a guide element that is configured to restrict the number of possible orientations of each roll support arm relative to one of the roll support couplers, for coupling with that roll support coupler.

BRIEF DESCRIPTION OF THE DRAWINGS

The objectives and features of the invention will become more readily apparent from the following detailed description taken in conjunction with the accompanying drawings in which.

DETAILED DESCRIPTION

Figure 1:
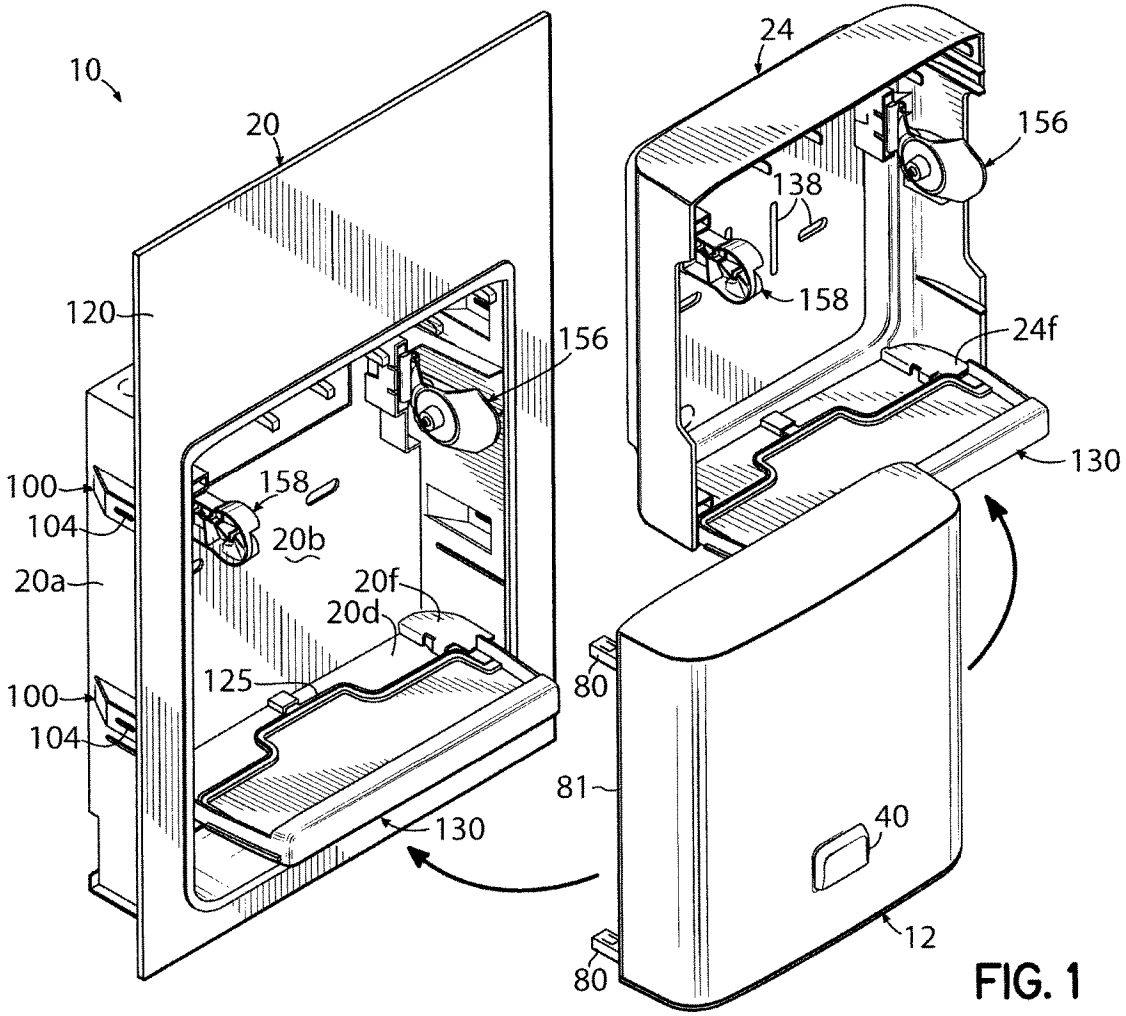
FIG. 1 is a perspective view of a system or assembly for dispensing paper product provided in roll form, in accordance with one embodiment of the invention.

To the extent that any meaning or definition of a term in this written document conflicts with any meaning or definition of the term in a document incorporated by reference, the meaning or definition assigned to the term in this written document shall govern. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

With reference to the figures, and more particularly to FIGS. 1-8, an illustrative dispenser system or assembly 10 shown in the figures is configured to dispense paper product that is provided in roll form. As used herein, the term "paper product" and related terms refer to a thin substrate made of cellulose fiber paper, and also refer to other dry or moist substrates, made for example of a nonwoven material. System 10 includes a hood or cover 12 that is selectively coupled to one of two different rear housing members 20, 24 that also form part of the system 10. Selective coupling between the hood 12 and either of the two different rear housing members 20, 24 is effective to jointly define an enclosure or housing, within which a roll 26 of paper product may be supported.

Figure 2:
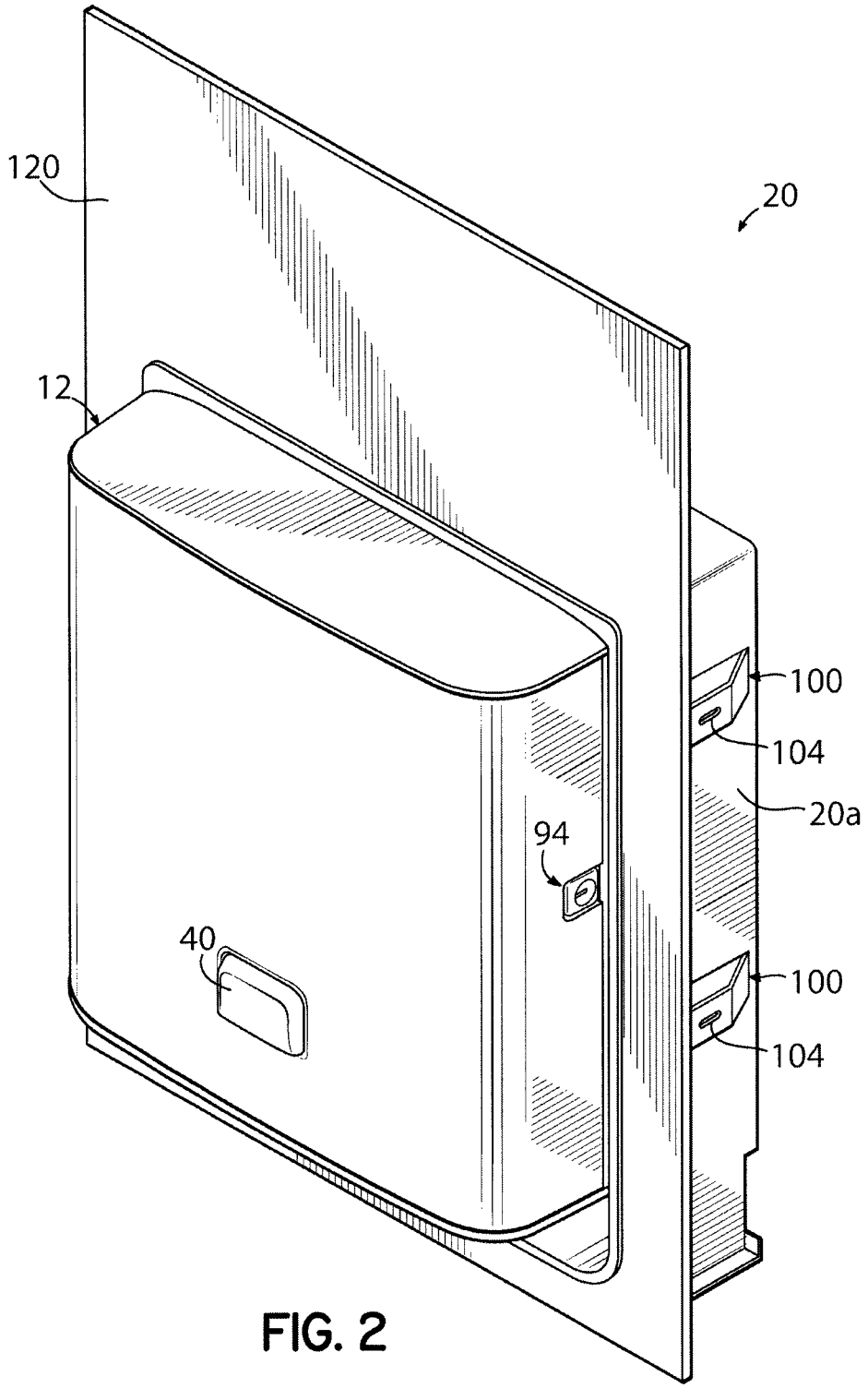
FIG. 2 is a perspective view of a housing or enclosure of the system of FIG. 1.
Figure 2A:
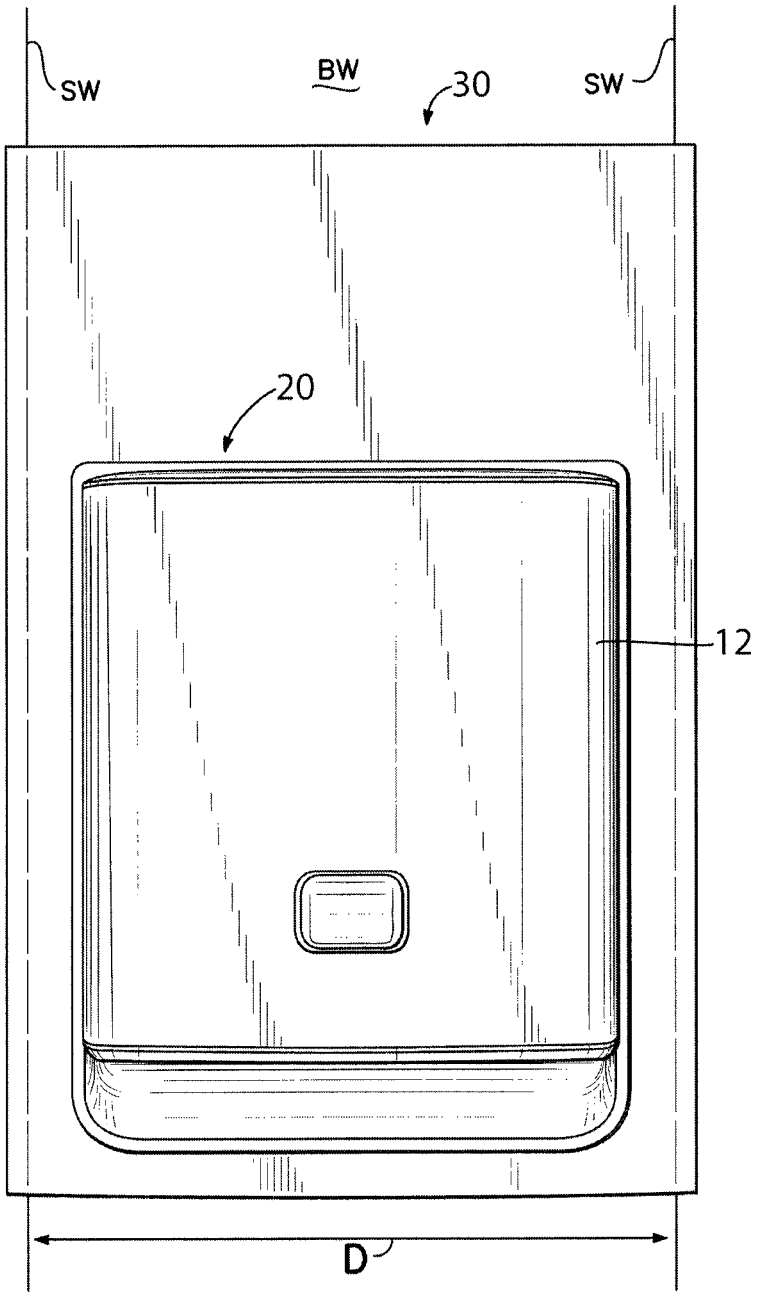
FIG. 2A is an elevation view of the housing of FIG. 2.
Figure 3:
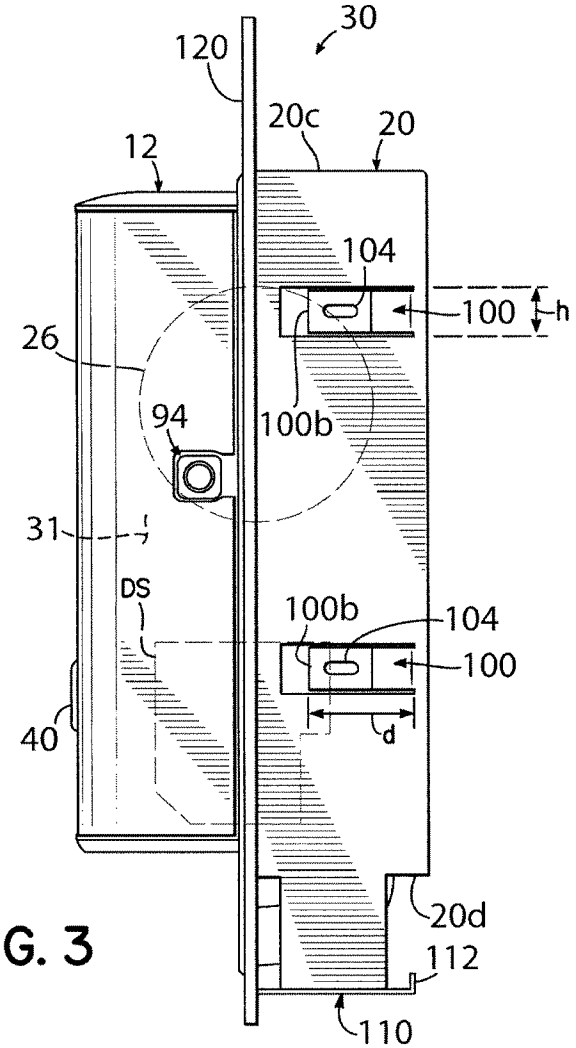
FIG. 3 is a side view of the housing of FIGS. 2 and 2A.
Figure 4:
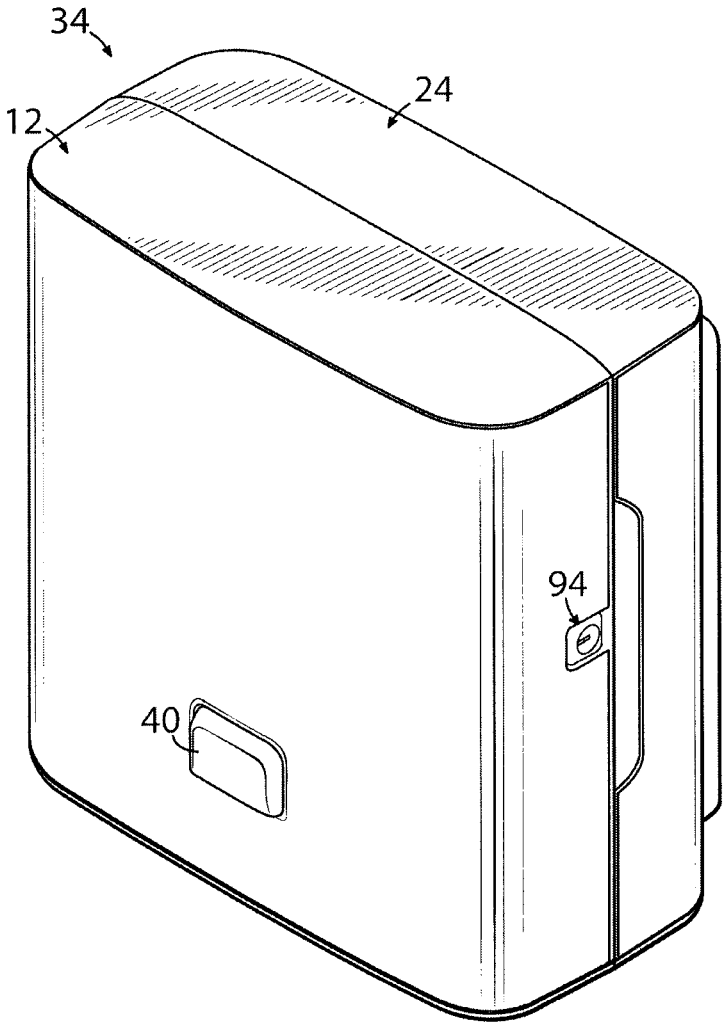
FIG. 4 is a perspective view of another housing or enclosure of the system of FIG. 1.

In one embodiment, particularly shown in FIGS. 2, 2A, and 3, rear housing member 20 and hood 12 jointly define, when coupled to one another, a housing 30. An interior 31 of housing 30 is configured to support, at least partially, a dispensing member DS that is schematically shown in FIG. 3. In another embodiment, particularly shown in FIGS. 4 and 5, the other rear housing member 24 and hood 12 jointly define, when coupled to one another, a housing 34, the interior 35 of which is also configured to support—at least partially—a dispensing member DS that is also shown schematically in FIG. 5. The dispensing member DS that is supported in either of the interiors 31 and 35 may be of the manual type i.e., such that manual actuation is required to cause paper from the roll 26 to be dispensed, or alternatively be of the automatic type.

Figure 6:
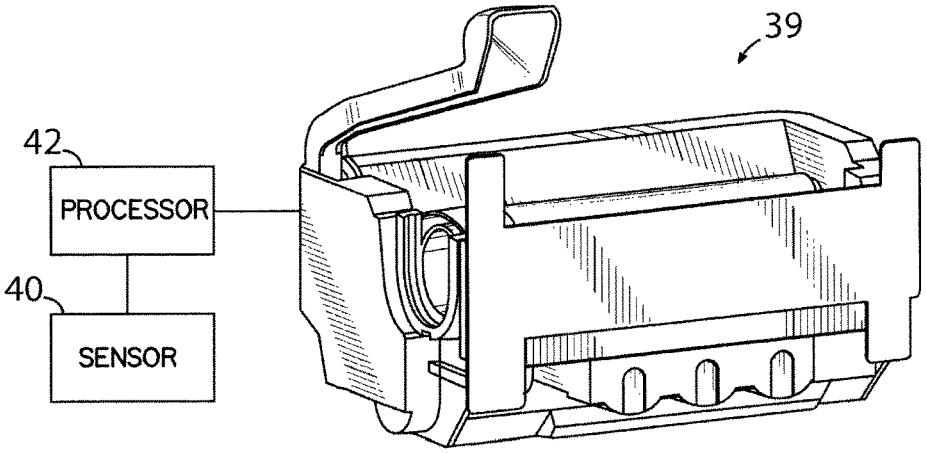
FIG. 6 is a partially schematic perspective view of a dispensing member of the system of FIG. 1, in accordance with one embodiment of the invention.

With particular reference to FIG. 6, that figure shows an example automatic-type dispensing member 39, which is of the "hands-free" type. Dispensing member 39 includes a sensor 40 that is configured to sense the presence of a part of a human body, such as a hand. Upon sensing of the part of a human body, the sensor 40 is configured to generate a signal to a processor 42, housed in the interior 31, 35 or exterior of the housing 30, 34, which in turn causes the dispensing member 39 to dispense paper from the roll 26 to the exterior of the housing 30, 34.

Figure 7:
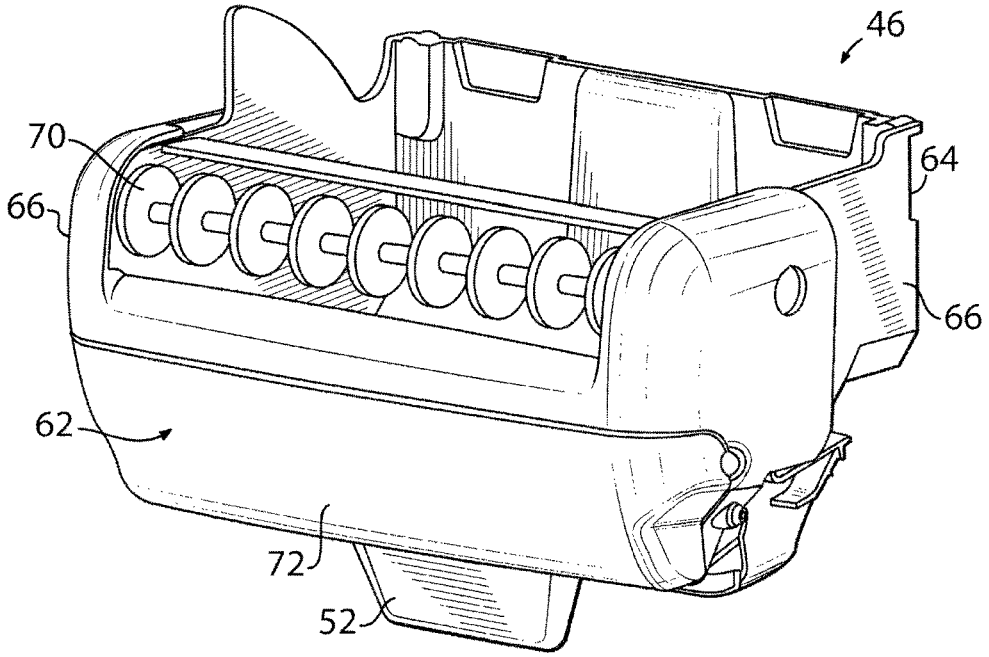
FIG. 7 is a perspective view of a dispensing member of the system of FIG. 1, in accordance with another embodiment of the invention.
Figure 8:
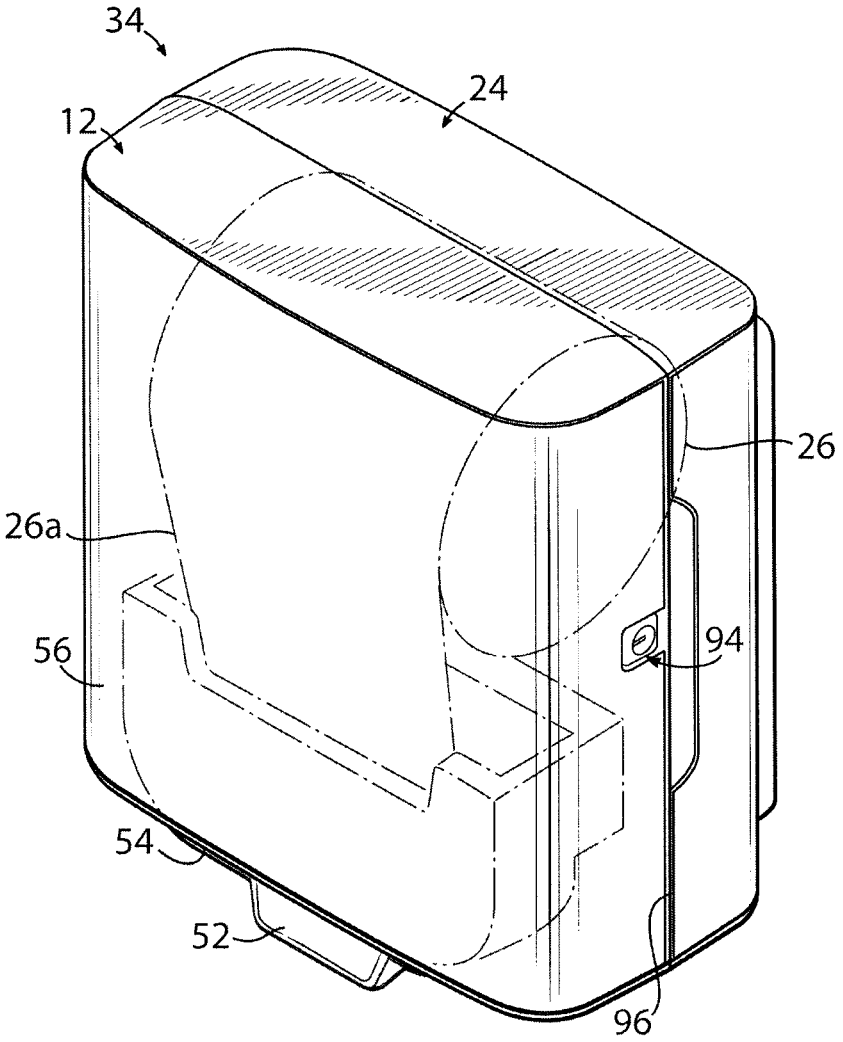
FIG. 8 is a perspective view of the housing of FIG. 5, in accordance with one embodiment of the invention.
Figure 9:
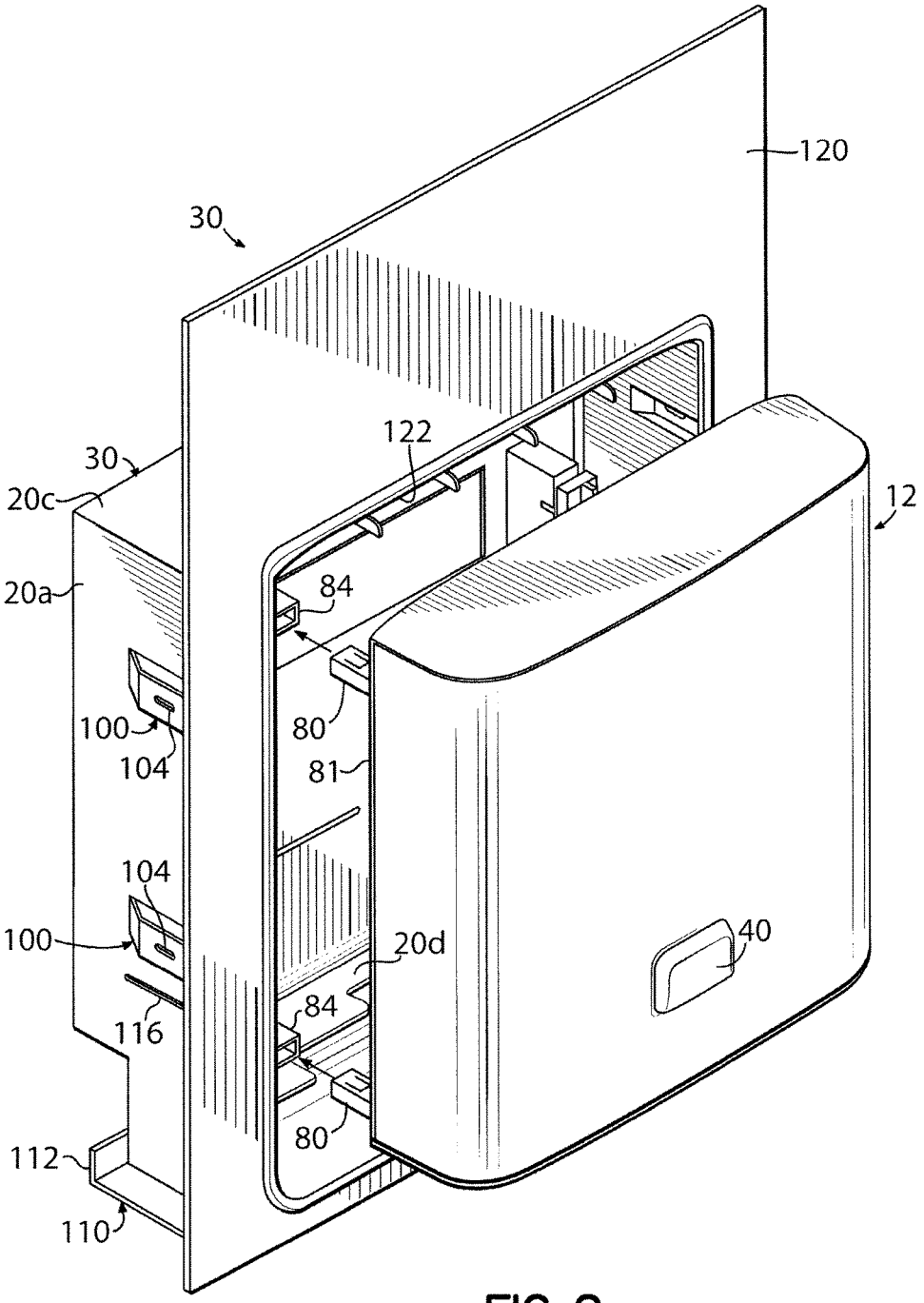
FIG. 9 is a partially disassembled perspective view of the housing of FIGS. 2, 2A, and 3.

Referring now to FIGS. 7 and 8, those figures show an example manual-type dispensing member 46, different from the dispensing member 39 of FIG. 6. FIG. 8 schematically shows dispensing member 46 being supported within example housing 34. It is contemplated, as those of ordinary skill will readily appreciate, that dispensing member 46 may also be supported within example housing 30. Dispensing member 46 includes a manually-actuated mechanism 48 that is actuated by a user applying a force to a handle or paper feed bar 52, movement of which is effective to dispense a predetermined length of paper product through a dispensing opening 54 of the housing 34. The paper feed bar 52 extends out of a lower portion 56 of the housing 34 adjacent the dispensing opening 54.

The example dispensing member 46 is in the form of a cassette that has a front wall 62, a rear wall 64, and two side walls 66. The dispensing member 46 includes a pressure roller 70, a rotary drum, and a rotary cutter (not shown). The web 26*a* of paper product is arranged to be fed from the roll 26 of paper product and into the dispensing member 46 for subsequent dispensing out of the dispensing opening 54 (FIG. 8). The dispensing member 46 further includes a hatch 72 which, when opened, is configured to provide access to the interior components of dispensing member 46. The dispensing member 46 is secured to the rear wall of the housing 34 through fasteners (not shown) or through a fastener-free coupling similar to those described below in connection with releasable, fastener-free coupling of other components of system 1. When the hood 12 is pivotally opened, so as to permit loading of a roll 26 of paper product, dispensing member 46 may also be accessed. Other features of example dispensing member 46 may be found in co-owned U.S. Pat. No. 8,955,790, titled DISPENSER, the contents of which are hereby expressly incorporated by reference herein for the sole purpose of disclosing the features associated with the cassette forming part of the dispensing apparatus described therein.

As stated above, the hood 12 is selectively coupled to either of the two different rear housing members 20, 24. Coupling of the hood 12 with either of the two rear housing members 20, 24 is of the releasable type, rather than of the permanent type. As used herein the term "releasable coupling," and related terms, refer to a type of coupling in which the coupled structures may be readily detached, decoupled, or otherwise separated from one another in a simple manner and without causing the destruction or damage of any of those structures. For sake of further explanation, a permanent—rather than "releasable"—type of coupling may refer, for example, to two structures that are integrally formed with one another, or which are adhesively attached, such that their separation would necessarily result in at least some level of damage to one or more of the parts being separated.

In the example embodiment of FIGS. 1-8, the releasable coupling between the hood 12 and the rear housing members 20, 24 is fastener-free, which facilitates easy, one-hand coupling of the hood 12 and rear housing members 20, 24 to one another. In that regard, the releasable coupling between hood 12 and the rear housing members 20, 24 does not include bolts, screws or rivets, for example. It is contemplated that, alternatively, coupling between hood 12 and rear housing members 20, 24 may include one or more types of fasteners, and still be considered releasable, rather than permanent coupling.

Figure 12:
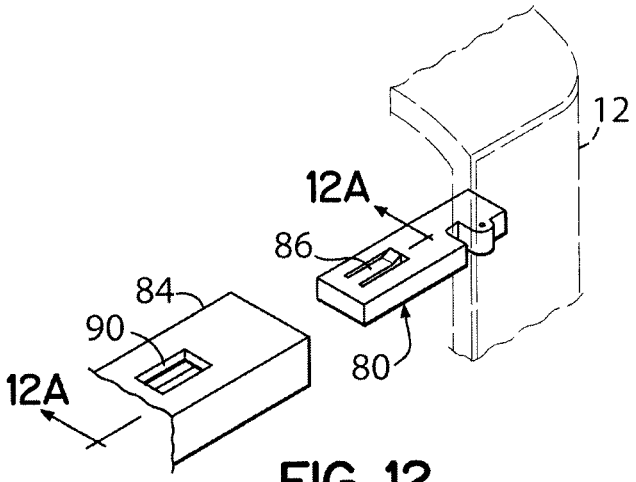
FIG. 12 is a broken away, perspective view, illustrating coupling between a hood and a rear housing member of the system of FIG. 1, in accordance with one embodiment of the invention.
Figure 12A:
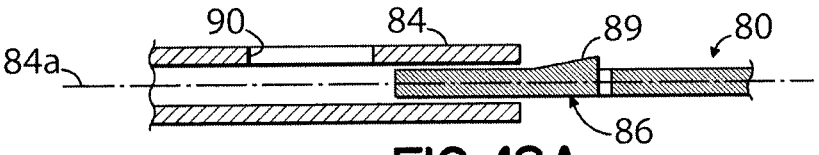
FIG. 12A is a cross-sectional view, taken generally along line 12A-12A of FIG. 12, illustrating coupling between male and female components of the hood and rear housing member.
Figure 12B:
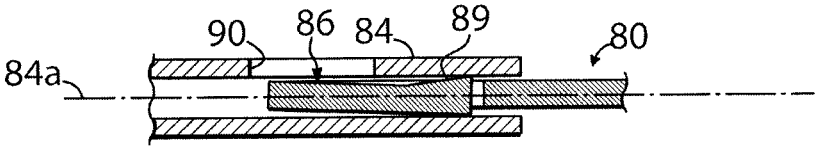
FIG. 12B is a view similar to FIG. 12A, further illustrating coupling between male and female components of the hood and rear housing member.
Figure 12C:
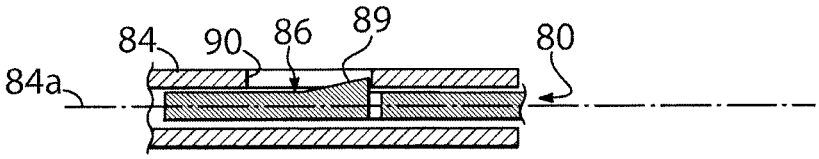
FIG. 12C is a view similar to FIGS. 12A and 12B, illustrating the hood and rear housing member in a coupled condition.

With continued reference to FIGS. 1, 2, 2A, and 3-8, and with further reference to FIGS. 9-12, 12A, 12B, 12C, 13A, and 13B, in the illustrative embodiments shown in those figures, releasable, fastener-free coupling between the hood 12 and the rear housing members 20, 24 is provided by male coupling components in the form of fingers 80 located along an edge 81 of hood 12, that are received within female hood coupling components in the form of channels 84, disposed at corresponding locations in the interior of each of the rear housing members 20, 24. With particular reference to FIGS. 12, 12A, 12B, and 12C, each finger 80 is received within a corresponding one of the channels 84 (FIG. 12A) for snap-coupling between finger 80 and channel 84. During insertion, a resilient element 86 of the finger 80 is depressed, as seen in FIG. 12B. Upon reaching a predetermined location within the channel 84, a raised stop 89 of the resilient element 86 snaps into place, extending through a locking aperture 90 in channel 84.

Engagement of raised stop 89 with the surfaces defining locking aperture 90 is effective to prevent movement of the finger 80 relative to channel 84, in a direction along the longitudinal axis 84*a* of the channel 84, as well as in the two directions that are orthogonal to that longitudinal axis 84*a*. Engagement of raised stop 89 with the surfaces defining locking aperture 90 locks the finger 80 in place and, more specifically, is effective to prevent unintended separation of the hood 12 from the rear housing member 20, 24 to which the hood 12 is coupled. Engagement of raised stop 89 with the surfaces defining locking aperture 90 is also effective to substantially prevent movement of the hood 12 relative to the rear housing member 20, 24 along the height, depth, and width dimensions of the resulting housing 30, 34. The type of releasable, fastener-free coupling between hood 12 and rear housing members 20, 24 in the embodiment of FIGS. 9-12, 12A, 12B, and 12C is also beneficial in that the exact location of the hood 12 relative to the rear housing member 20, 24 to which the hood 12 is being coupled is predetermined, which enhances ease of assembly, as well as alignment between hood 12 and the rear housing member 20, 24. More specifically, the exact location and orientation of the hood 12 relative to the rear housing member 20, 24 is determined by the respective locations of the raised stop 89 and of the locking aperture 90, which engage one another at a specific location along the channel 84.

Figure 5:
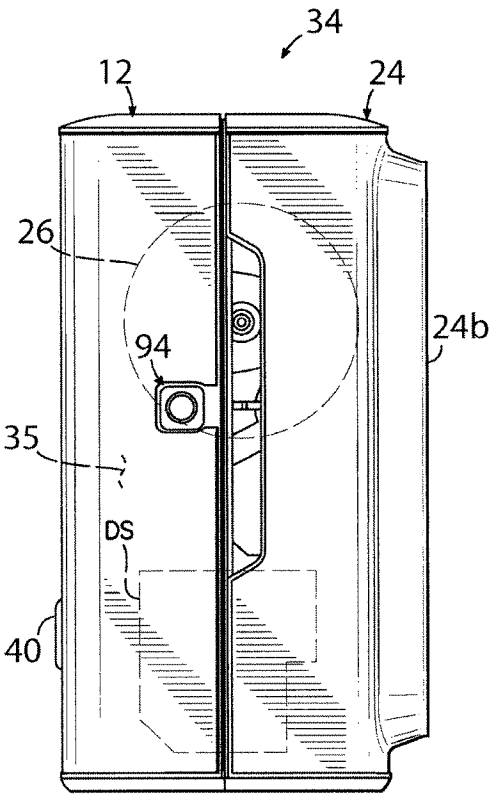
FIG. 5 is a side view of the housing of FIG. 5.
Figure 13A:
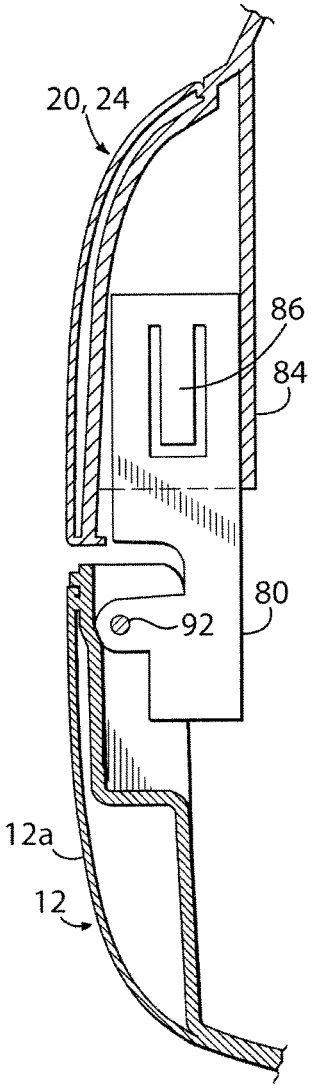
FIG. 13A is a broken away, cross-sectional view, illustrating the hood and rear housing member of FIGS. 12A-12C in a coupled condition.
Figure 13B:
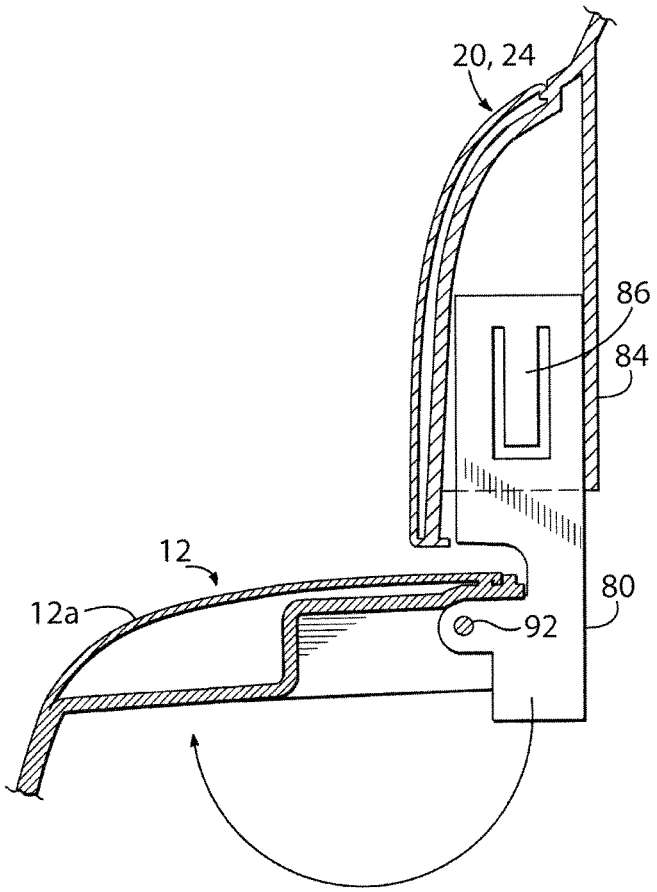
FIG. 13B is a view similar to FIG. 13A, illustrating pivotal movement of a cover of the hood of FIG. 13A.

Referring now particularly to FIGS. 13A and 13B, those figures show hinged coupling between the fingers 80 and the main cover portion 12*a* of hood 12. More specifically, each of the fingers 80 (one shown in the figures) includes a hinge 92 that permits pivoting movement of the main cover portion 12*a* of hood 12 relative to the corresponding finger 80, and thereby relative to the rear housing member 20, 24 to which hood 12 is coupled, generally about the respective axis of the hinge 92. Pivoting movement of main cover portion 12*a* permits main cover portion 12*a* to act as a door of the resulting housing 30, 34, effective to provide access into the interior 31, 35 (FIGS. 3 and 5). A latch feature 94 located along an edge 96 of hood 12 (FIG. 8), opposite the edge 81 (FIG. 9) of hood 12, cooperates with a catch (not shown) of the rear housing member 20, 24 to further provide coupling between hood 12 and the rear housing members 20, 24. Engagement of latch feature 94 with the catch is effective to prevent undesired pivoting movement of the main cover portion 12*a* of hood 12.

While in the embodiments shown in the above-referenced figures the hood 12 has two fingers 80 that cooperate with two corresponding channels 84 in the rear housing member 20, 24, variations are contemplated. For example, the hood 12 and rear housing members 20, 24 may have respective fingers 80 and channels 84 in numbers other than the two of the example embodiments in those figures. Similarly, it is contemplated that one or more fingers 80 may be located in the interior or even exterior of the rear housing members 20, 24, while one or more cooperating channels 84 may form part of the hood 12. An additional alternative includes a hood 12 having both, a finger 80 and a channel 84, that cooperate, respectively, with a channel 84 and hood forming part of the rear housing member 20, 24. Further, releasable, fastener-free coupling of the hood 12 and rear housing members 20, 24 may be provided by structural elements different from the illustrative, yet non-limiting fingers 80 and channels 84 in the illustrated embodiments.

Referring with particularity to FIGS. 1, 2, 2A, 3, 9, and 10, the example rear housing member 20 shown in those figures is configured for insertion into a recessed space and to be secured to a pair of external side walls SW defining that recessed space (FIG. 2A). To that end, rear housing member 20 includes a pair of side walls 20*a*, each of which includes one or more resilient side tabs 100 that flex by an amount that depends on the width of the recessed space i.e., the distance D between the external side walls SW (FIG. 2A). During installation, and upon being depressed by engagement with the external side walls SW, the tabs 100 exert an opposite, outward force against the external side walls SW, effective to frictionally hold the rear housing member 20 in place. While the rear housing 20 is frictionally supported against the external side walls SW, thereby staying at the desired location, an installer may be able to secure the rear housing 20 in place, by using one or more fasteners, such as screws (not shown). The fasteners are inserted, in this particular non-limiting example, through fastener openings 104 that are located in the tabs 100, and into engagement with the external side walls SW. It is contemplated that, alternatively, the fastener openings 104 may be located elsewhere on the side walls 20*a* of the rear housing member 20.

The number of tabs 100, as well as the material, shape, and structure making up those tabs 100, are suitably chosen so as to be resilient enough, such that they may be depressed upon engaging contact with the external side walls SW, as the rear housing member 20 is inserted into the recessed space. Further, the number of tabs 100, as well as the material, shape, and structure making up those tabs 100 are suitably chosen such, upon being depressed, the tabs 100 are able exert a sufficiently high force against the external side walls SW, effective to support the weight of the rear housing member 20 through frictional engagement with the external side walls SW. In that regard, the rear housing member 20 may for example have a total of four tabs 100, with two tabs 100 on each of the side walls 20*a*, with the tabs 100 made out of metal, and more specifically made of sheet steel having a thickness of about 1/16 inches (about 1.6 mm), and each protruding by about 5/8 inches (about 16 mm) from the surface of the respective side wall 20*a*. Further, each of the tabs 100 may be integrally formed with the adjacent side wall 20*a*. For example, in the embodiment shown in FIG. 3, each tab 100 is integrally formed with the side adjacent side wall 20*a*, has one connected end 100*a* and one free end 100*b* (i.e., supported in cantilever fashion), and has a height "h" of about 15/16 inch (about 24 mm), and a depth "d" (i.e., the dimension parallel to the depth dimension of the rear housing member 20) of about 70 mm. Other combinations of numbers of tabs 100, as well as materials, shapes, and structural configurations are contemplated within the scope of the present disclosure, with those of ordinary skill in the art readily appreciating that the specific details discussed above with respect to the illustrative tabs 100 are described by way of example, rather than intending to be limiting. Further, the dimensions of each of the tabs 100 may be suitably chosen so to accommodate a range of widths i.e., a range of distances D between the external side walls SW, that can vary between about 5 mm and about 20 mm. For example, the tabs 100 may be configured to frictionally support the weight of the rear housing member 20 against external side walls SW having a distance D of about 380 mm between them, as well as external side walls SW having a distance D of about 400 mm between them.

Figure 14B:
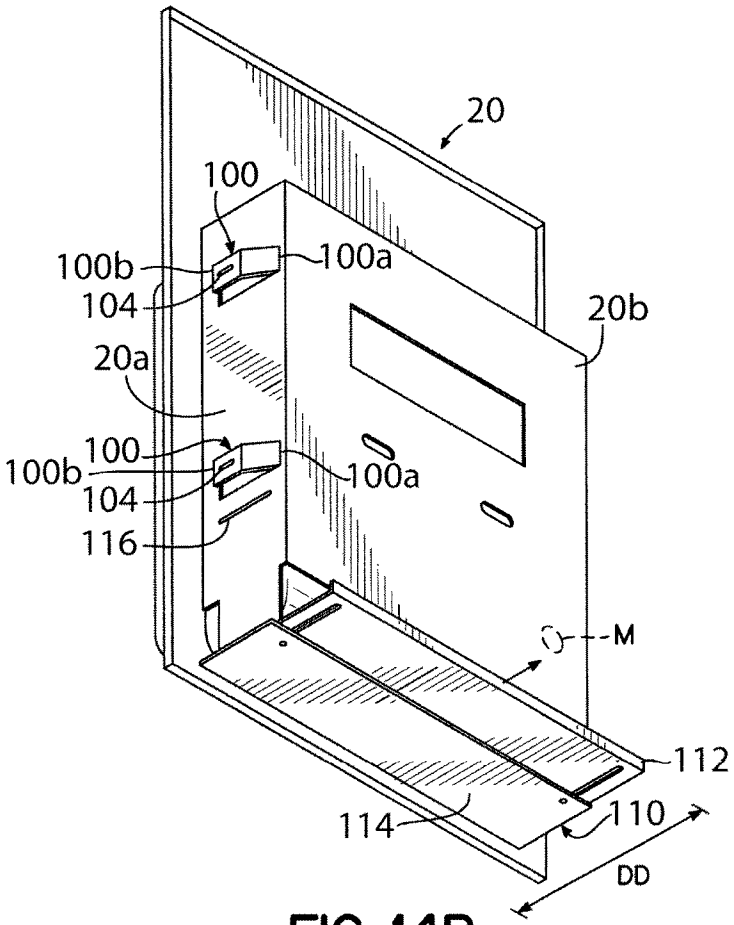
FIG. 14B is a view similar to FIG. 14A, illustrating a bottom plate of the rear housing member in an extended condition.
Figure 14A:
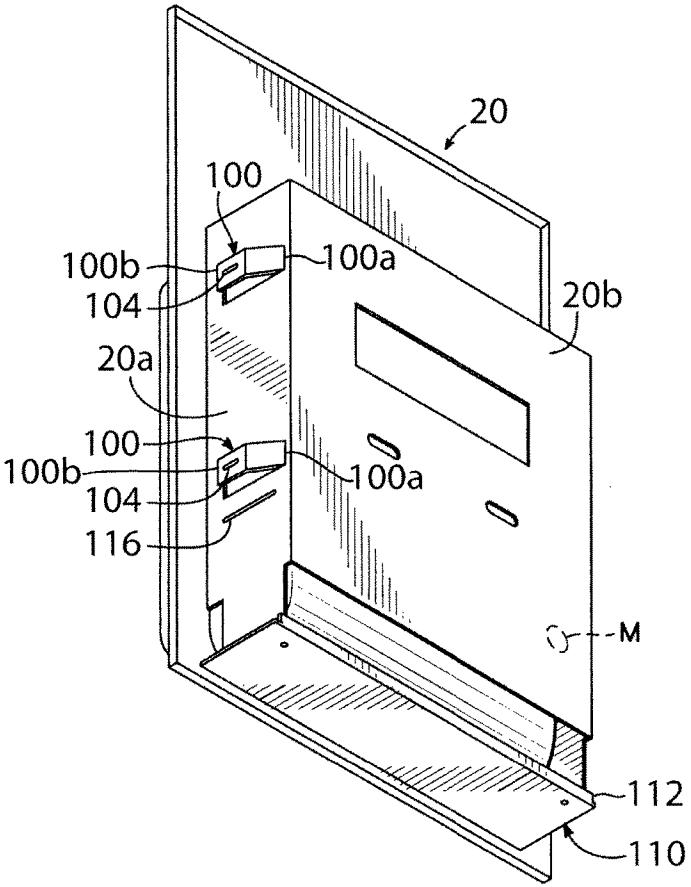
FIG. 14A is another perspective view of the rear housing member of FIG. 10, as seen from a backside thereof.

With continued particular reference to FIGS. 1, 2, 2A, 3, 9, and 10, and further referring to FIGS. 14A and 14B, the rear housing member 20 further includes a bottom plate 110 that is adjustable in the depth dimension DD of rear housing member 20, to accommodate installation of that rear housing member 20 into recessed spaces of various depths. More specifically, in the shown example embodiment, the bottom plate 110 is made up of two bottom plate members 112, 114 that are slidable relative to one another, so as to permit the bottom plate 110 to attain a continued (rather than discrete) plurality of available depths. The adjustable bottom plate 110 may be desirable to accommodate recessed spaces of different depths, and enhances stability of the dispenser installed in the recessed space. More specifically, the bottom plate member 112 may be extended so as to contact an external back wall BW (FIG. 2A) of the recessed space, with that contact being effective to aid in preventing inward (i.e., toward back wall BW) movement or even deflection of the rear housing member 20 during installation and inward movement of the resulting housing 30 in use.

The rear housing member 20 in the illustrated embodiment also includes an installation guide slot 116 on one of side walls 20*a* that permits viewing, from the interior of rear housing member 20, of a mark (not shown) on one of the external side walls SW. The mark may correspond, for example, to a height requirement for the resulting dispenser being installed, necessary to comply with specific regulations. Alternatively, each of the two side walls 20*a* may include a respective guide slot 116. For example, prior to or during installation, the installer may measure and mark on one or both external side walls SW, a regulation-based height of the dispenser relative to the ground. As the rear housing member 20 is inserted in the recessed space, the installer may raise or lower the rear housing member 20 until the installation mark is seen through the installation guide slot 116. The tabs 100 would then frictionally support the rear housing member 20 in place, against the external side walls SW, and the installer may then proceed to drive a screw or some other fastener through each fastener opening 104 and through the side walls SW. The screw or other fastener would, in turn, secure the rear housing member 20 in place, in the recessed space. Further, a wire hole M is located on a rear wall 20*b*, extending between side walls 20*a*, and is configured to allow passage of a power wire and/or other wiring providing power and/or communication to the various components within housing 30. For example, wire hole M may receive a power wire there through, configured to provide power to a dispensing member such as the example dispensing members 39 and 46 of FIGS. 6 and 7, respectively.

The various features described above allow a relative easy, quick, and in some cases one-handed installation of the rear housing member 20 into a recessed space, and accommodate installation into recessed spaces for example having depths in the range of about 97 mm to about 267 mm, and/or widths (i.e., the distance between the external side walls SW in the recessed space) in the range of about 380 mm to about 400 mm, and in some embodiments between about 384 mm and about 389 mm.

Figure 10:
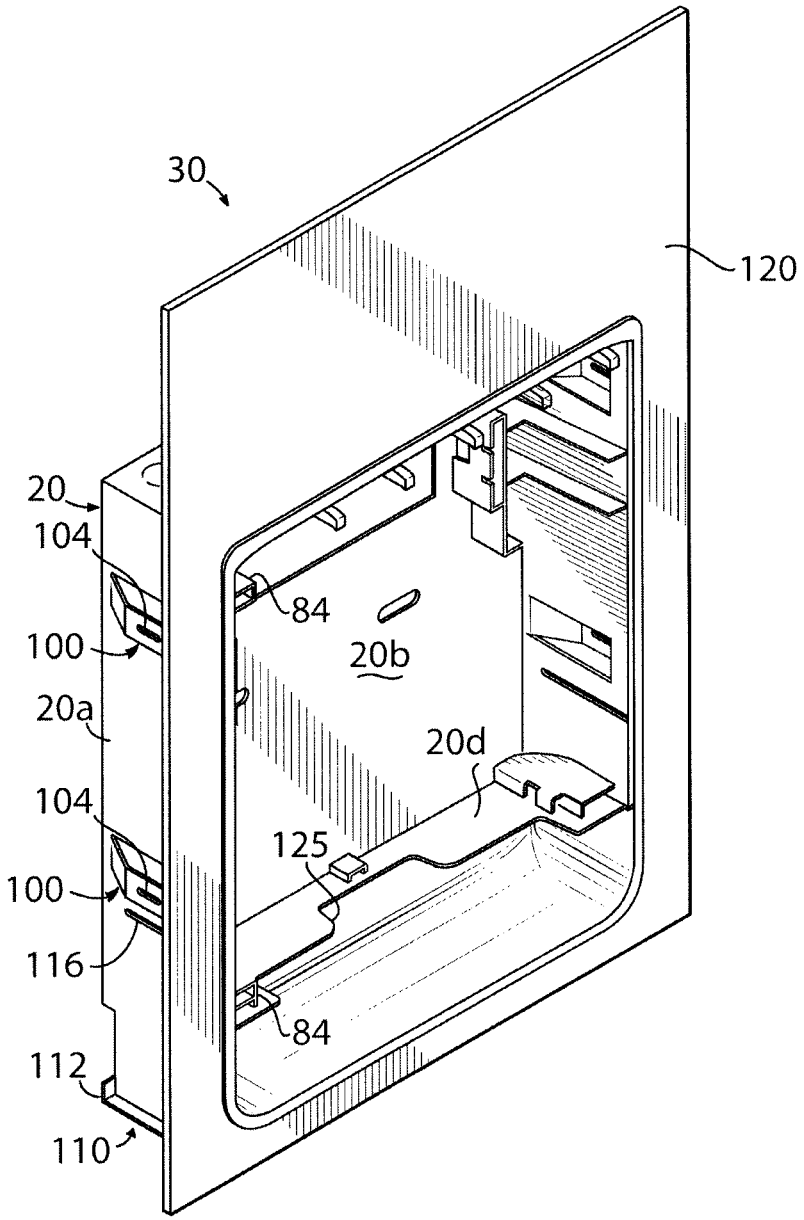
FIG. 10 is a perspective view of a rear housing member of the housing of FIG. 9.
Figure 11:
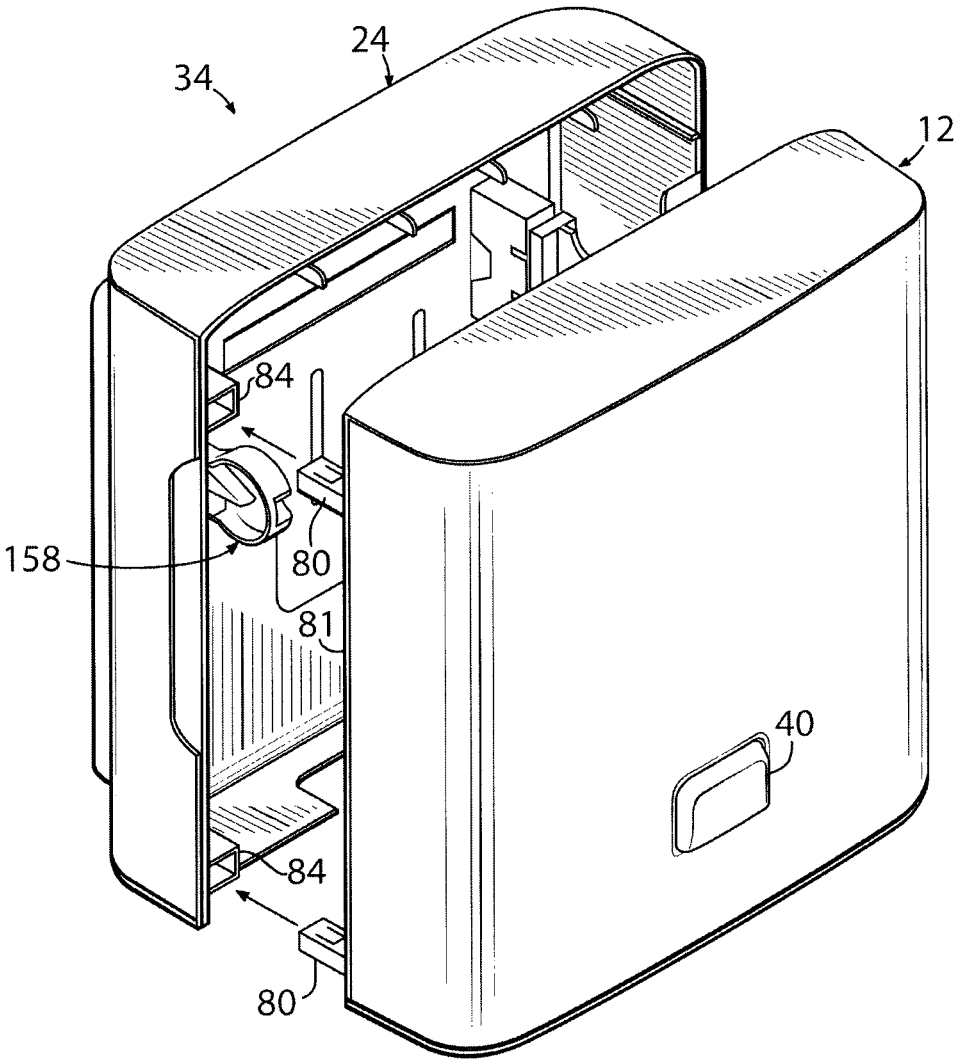
FIG. 11 is a partially disassembled perspective view of the housing of FIGS. 4, 5, and 8.

Rear housing member 20 further includes a front panel 120 that surrounds a front opening 122 of the rear housing member 20 and which is aesthetically advantageous, to the extent that it provides a finished appearance to the dispenser that is ultimately installed. The entirety or at least a substantial portion of front panel 120 may be made of metal, and more specifically, in certain embodiments, of a fingerprint-resistant type stainless steel type 304 (per ASTM A240), such as the material sold under the trade name Uginox® Cleantouch, commercially available from Aperam Stainless Europe, of France, and which includes a 4 μm-thick fingerprint-resistant coating. The rear housing member 20 further includes top and bottom walls 20*c*, 20*d* disposed opposite one another, that extend between the side walls 20*a* of the rear housing member 20 and which are connected to rear wall 20*b*. Bottom wall 20*c* is adjacent and spaced from the bottom plate 110 (FIGS. 14A and 14B), and is disposed in the interior of rear housing member 20 (FIG. 10).

Figure 15:
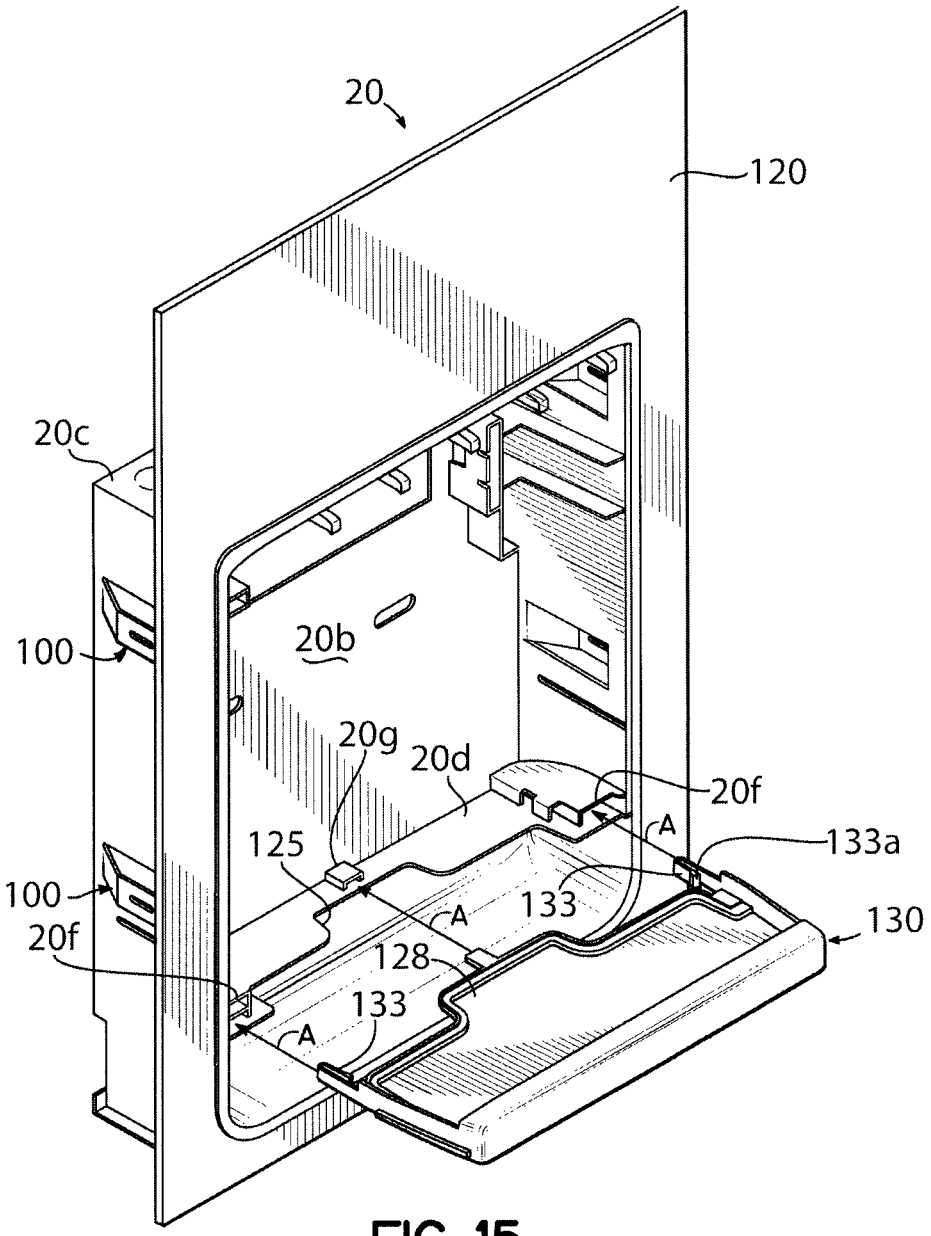
FIG. 15 is a perspective view of the rear housing member of FIG. 10, illustrating coupling of a bottom console to the rear housing member.

With continued reference to FIGS. 1, 2, 2A, 3-13, 14A, and 14B, and further referring to FIG. 15, the bottom wall 20*d* of rear housing member 20 includes a notch 125. Notch 125 defines an opening in bottom wall 20*d* that permits a push bar or paper feed bar 52 of a manual-type dispensing member (FIGS. 7 and 8), if forming part of system 10, to extend to the exterior of the housing 30. When a dispensing member is used that does not include a paper feed bar 52, such as the exemplary dispensing member 39 of FIG. 6, the notch 125 may be engaged by a centrally located protruding portion 128 of a bottom console 130 that is releasably coupled to the bottom wall 20*d* of the rear housing member 20. Engagement of protruding portion 128 with the notch 125 is effective to close the opening otherwise available for extension of the paper feed bar 52.

Releasable coupling of the bottom wall 20*d* and bottom console 130 in the illustrated embodiment is also free of fasteners (e.g., screws, bolts), which enhances the ease of coupling and decoupling between bottom wall 20*d* and bottom console 130, and is provided by male and female components, as well as resilient elements, similar to those described above with reference to the coupling between the hood 12 and each of the two rear housing members 20, 24. Specifically, in the illustrated embodiment, the bottom console 130 includes male components in the form of a pair of outer fingers 132, and a centrally located finger 134, which are received within respective female components in the form of a pair of outer channels 20*f* and a centrally located channel 20*g*. Those of ordinary skill in the art will readily appreciate that releasable, fastener-free coupling between bottom wall 20*d* and bottom console 130 may be accomplished through other means. For example, and without limitation, the bottom wall 20*d* may have a combination of male and female components (e.g., fingers and channels, respectively) that cooperate with a corresponding combination of female and male components of the bottom console 130. Similarly, it is contemplated that the bottom wall 20*d* may have only male components (e.g., fingers), which are configured to be received within cooperating female components (e.g., channels) of the bottom console 130.

In the example embodiment of FIG. 15, the outer fingers 132 include respective resilient elements 133 having raised stops 133*a*, similar to the resilient element 86 and corresponding raised stops 89 described above in connection with the releasable coupling of hood 12 with the rear housing members 20, 24. During insertion (arrows A), the resilient elements 133 flex until the raised stops 133*a* engage the surfaces defining respective locking apertures 137 of outer channels 20*f*. Engagement of raised stops 133*a* with the surfaces defining the locking apertures 137 are effective to secure the bottom console 130 in place, relative to bottom wall 20*d*. Releasable, fastener-free coupling of bottom wall 20*d* and bottom console 130 with one another may be desirable to permit quick, one-handed assembly and disassembly of the dispenser being installed.

Figure 16A:
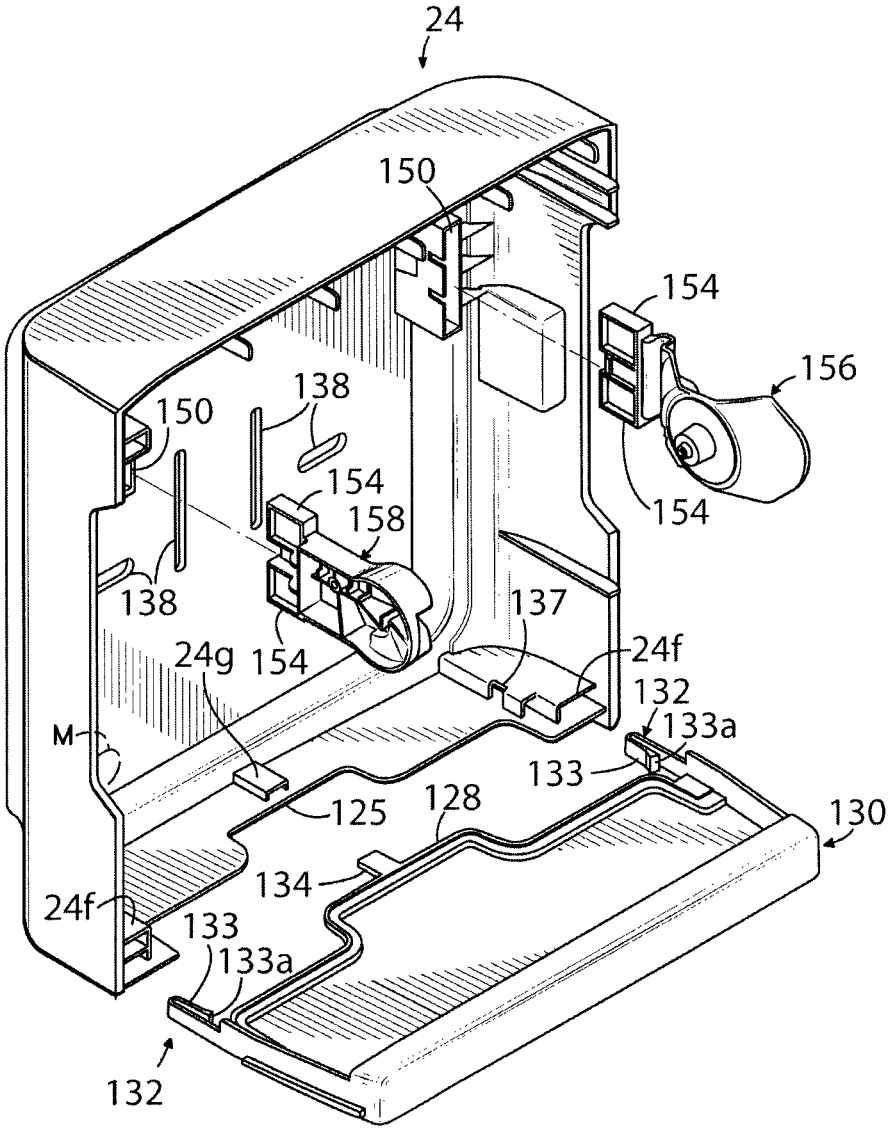
FIG. 16A is a perspective view of a rear housing member of the housing of FIGS. 4, 5, and 8, illustrating coupling of the bottom console of FIG. 15 to the rear housing member.
Figure 16B:
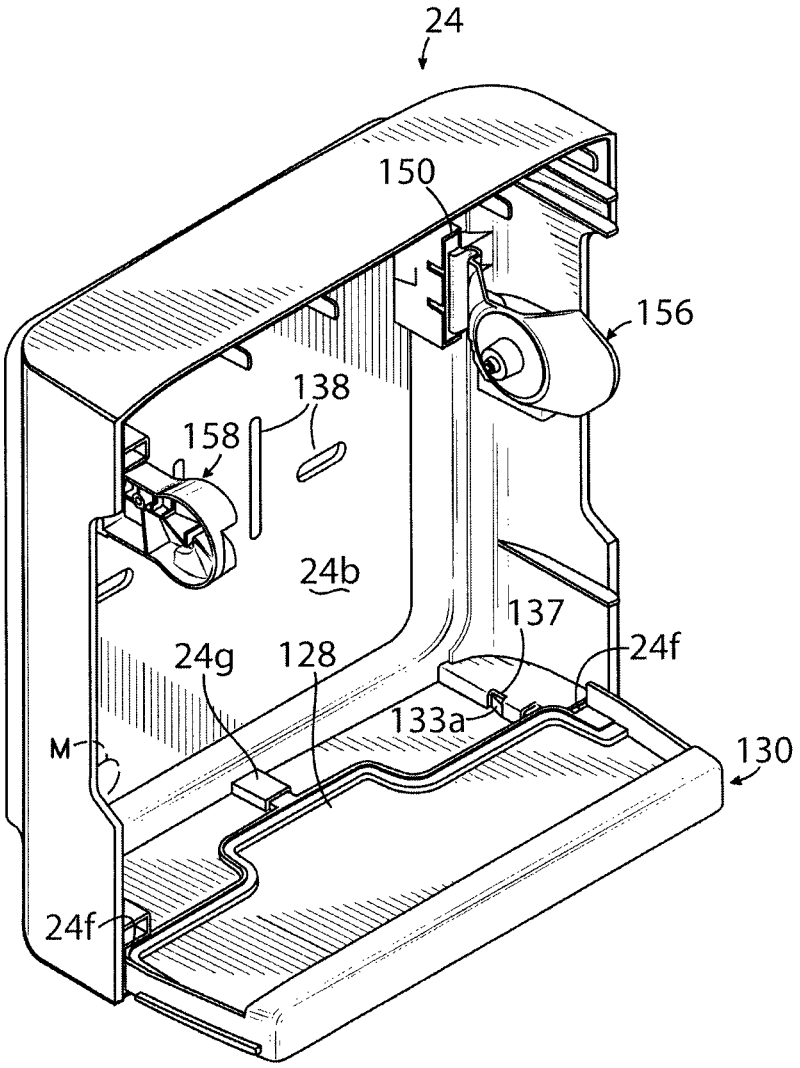
FIG. 16B is a perspective view similar to FIG. 16A, showing the bottom console being already coupled to the rear housing member.
Figure 17A:
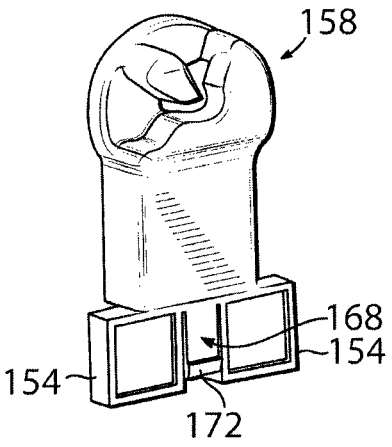
FIG. 17A is a perspective view of a roll support arm of the system of FIG. 1, in accordance with one embodiment of the invention.
Figure 17B:
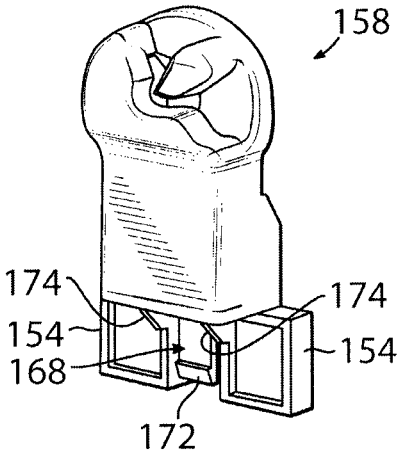
FIG. 17B is another perspective view of the roll support arm of FIG. 17A, from a rear side thereof.

FIGS. 16A and 16B show bottom console 130 being releasably coupled to an example rear housing member 24 also forming part of system or assembly 10. For ease of understanding, like reference numerals in FIGS. 16A and 16B refer to similar features in FIG. 15. The bottom console 130 in FIGS. 16A and 16B is releasably coupled to a bottom wall 24*d* of rear housing member 24 in a manner similar to the manner in which example recessed-type rear housing member 20 may also be releasably coupled to bottom console 130. Specifically, a pair of outer channels 24*f* and a centrally located channel 24*g* of rear housing member 24 respectively receive the outer and central fingers 133, 134 of console 30 so as to permit selective releasable, fastener-free coupling of those two structures to one another. The centrally located protruding portion 128 of bottom console 130 engages the notch 125 when the bottom console 130 and bottom wall 24*d* are coupled to one another and is effective, in that regard, to close the opening in bottom wall 24*d* of rear housing member 24 that is otherwise available for extension of paper feed bar 52 there through.

With continued particular reference to FIGS. 16A and 16B, those figures illustrate other features of the example second rear housing member 24 of the system or assembly 10. As discussed above, rear housing member 24 is selectively coupled with hood 12, in place of rear housing member 20, to thereby jointly define housing or housing 34. Coupling between hood 12 and rear housing member 24 is similar in components, functionality, and contemplated variations thereof, to that described above in connection with coupling between hood 12 and rear housing member 20. Second rear housing member 24 is configured for mounting of the resulting housing 34 on a surface, such as a wall, rather than within a recessed space. To that end, a rear wall 24*b* of rear housing member 24 includes one or more mounting features 138, such as holes and/or slots, that permit the insertion there through of a fastener such as a screw, effective to permit securement of the rear housing member 24, and of the resulting housing 34, to a wall. Rear wall 24*b* also includes a wire hole M, similar in structure and functionality to the wire hole M on the rear wall 20*b* of rear housing member 20 (FIGS. 14A and 14B).

With continued reference to 1, 2, 2A, 3-13, 14A, 14B, 15, 16A, 16B, and further referring to FIGS. 17A, 17B, 18, 19A, and 19B each of the rear housing members 20, 24 includes roll support couplers 150 that in the illustrated embodiments are in the form of female elements configured to receive therein respective male elements 154 of each of a pair of roll support arms 156, 158. Coupling between the roll support arms 156, 158 and the roll support couplers 150, in the illustrated embodiment, is of the releasable type, and further is of the fastener-free type, which may be desirable to ease coupling and decoupling of the roll support arms 156, 158 to/from the roll support couplers 150. The roll support arms 156, 158 in the example embodiment of the figures include respective arm resilient elements 166, 168 that flex during insertion of male elements 154 into the roll support couplers 150, and which lock the roll support arms 156, 158 in place, by engagement of respective raised stops 170, 172 similar to the raised stops 89 of resilient elements 86 in the coupling of hood 12 with rear housing member 20. The roll support arms 156, 158 in the figures further include respective guide elements in the form of ramps 174. The ramps 174 prevent insertion of a roll support arm 156, 158 in the wrong orientation, and are therefore effective to restrict insertion of a roll support arm 156, 158 to one orientation into one of the roll support couplers 150.

Figure 19B:
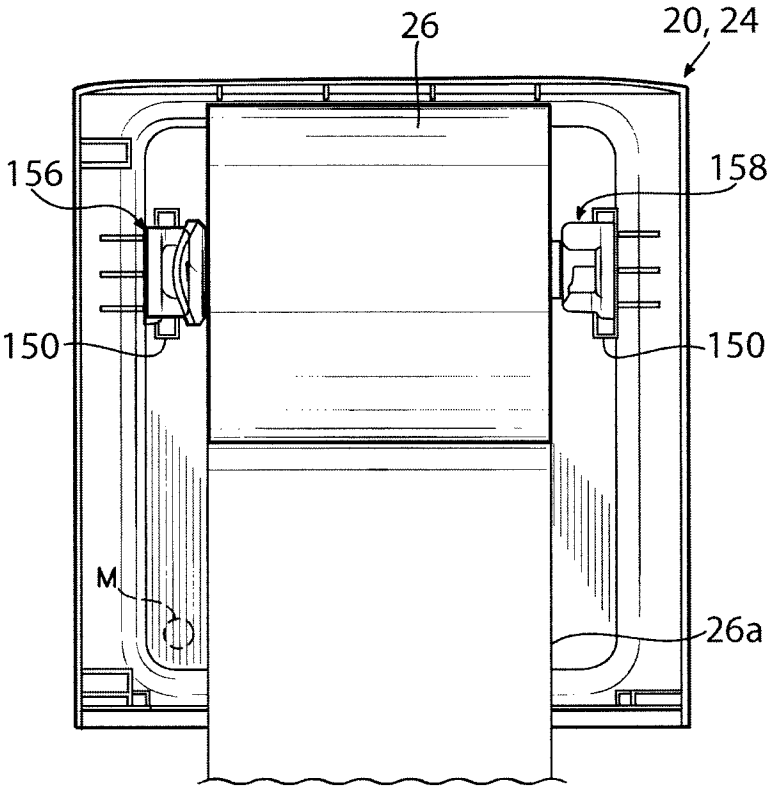
FIG. 19B is a view similar to FIG. 19A, showing the dispensing of paper product from a roll in a second orientation.
Figure 19A:
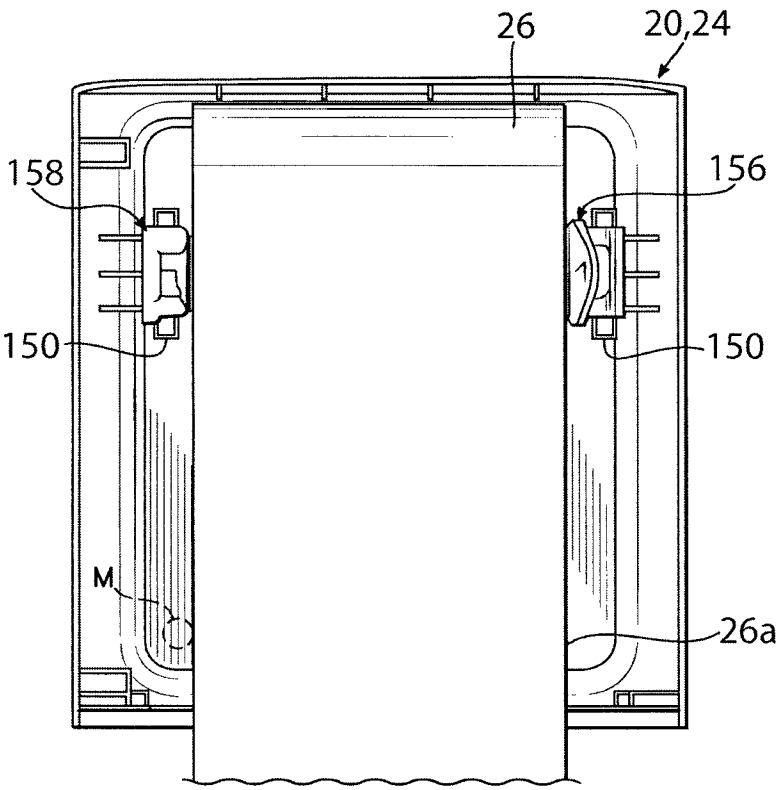
FIG. 19A is an elevation view, showing an interior of a housing of the system of FIG. 1, dispensing paper product from a roll in a first orientation.
Figure 20:
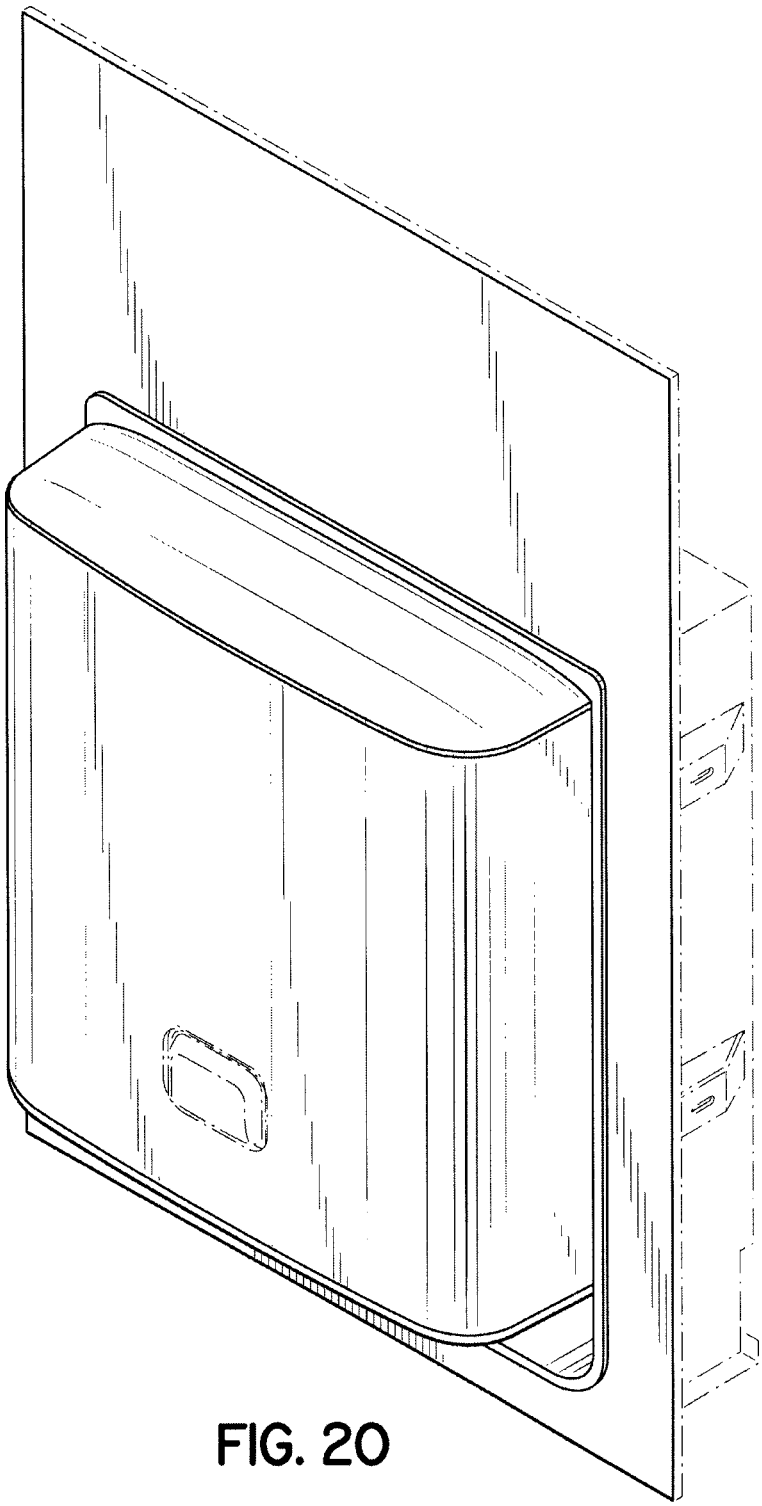
FIG. 20 is a perspective view of a housing of the system of FIG. 1, in accordance with another embodiment of the invention.
Figure 21:
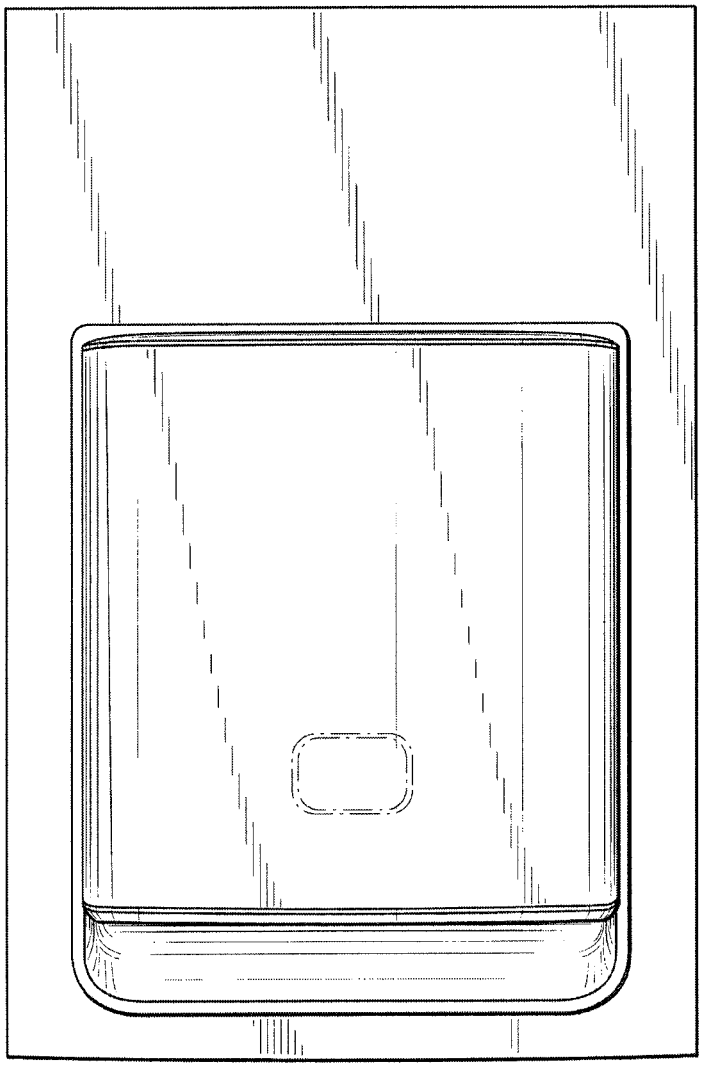
FIG. 21 is an elevation view of the housing of FIG. 20.
Figure 22:
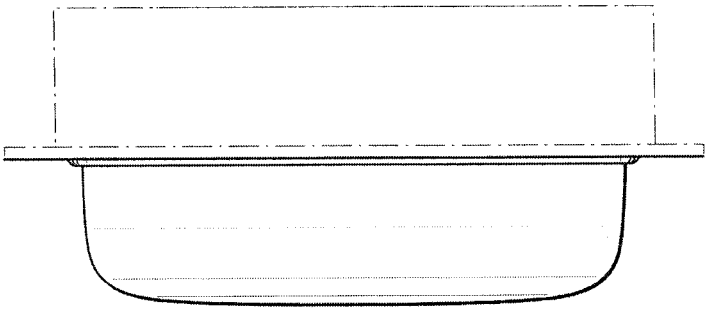
FIG. 22 is a top view of the housing of FIGS. 20 and 21.
Figure 23:
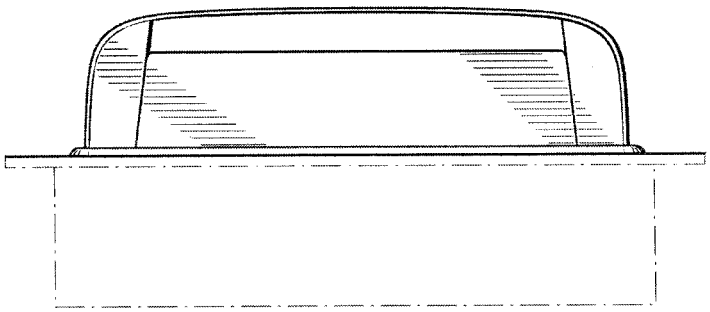
FIG. 23 is a bottom view of the housing of FIGS. 20, 21, and 22.
Figure 24:
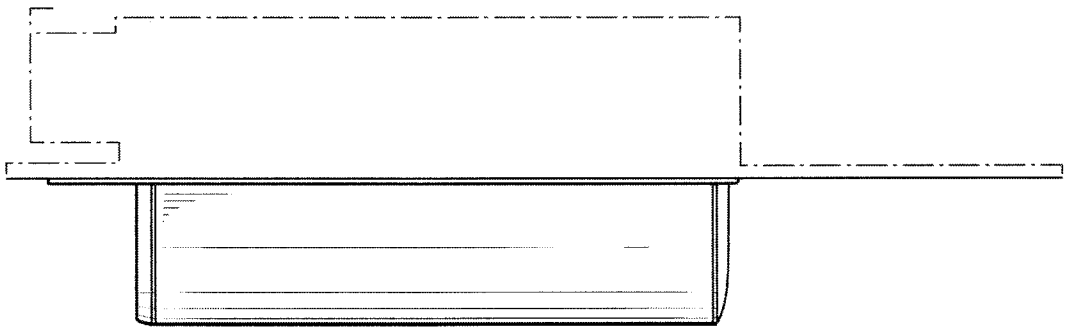
FIG. 24 is a side view of the housing of FIGS. 20, 21, 22, and 23.

Further, in the illustrated example embodiments, and as shown in FIGS. 19A and 19B, the roll support couplers 150 and roll support arms 156, 158 are designed such that the roll support arms 156, 158 may swap their positions with one another i.e., between the left and right side roll support couplers 150. That flexibility allows the resulting dispenser to accommodate rolls 26 of paper product in either of the two available orientations of the roll 26 i.e., so as to dispense the web of paper clockwise or counter-clockwise (i.e., the web being released from the front, as shown in FIG. 19A or from the back of the roll 26, as shown in FIG. 19B).

Figure 18:
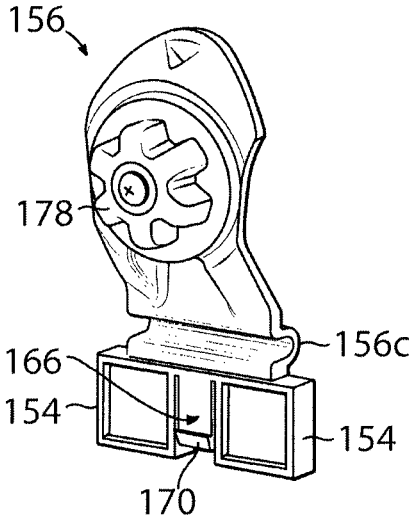
FIG. 18 is a perspective view of a roll support arm of the system of FIG. 1, in accordance with another embodiment of the invention.

In the illustrated embodiment also, system 10 includes one or more flex-type roll support arms 156 and one or more fixed-type roll support arms 158. The flex-type roll support arm 156 is designed to flex in the width dimension, so as to accommodate rolls 26 of various widths, such as rolls in the range from about 195 mm to about 210 mm in width, for example. The fixed-type roll support arm 158, on the other hand, is designed to have a substantially fixed position in the width dimension of the dispenser (and of the roll 26 of paper product). To that end, the flex-type roll support arm 156 has an integral hinge element 156*c* that permits flexing of a hub 178 of that roll support arm 156 in the width dimension, relative to the male elements 154 of that roll support arm 156, as shown in FIG. 18.

It is contemplated that releasable coupling between the roll support arms 156, 158 and roll support couplers 150 may, alternatively, be reversed i.e., such that the male and female elements are reversed relative to those in the embodiment shown in the figures. Similarly, alternative embodiments include each of the roll support arms 156, 158 having a combination of male and female components cooperating with female and male components, respectively, of the roll support couplers 150.

FIGS. 20-24 illustrate various other features of a recessed-type dispenser, such as the forming part of system 10 (FIG. 1), and the description of which may be referred to for an understanding of the features of the dispenser in FIGS. 20-24 as well.

Referring generally to the various embodiments of the figures described above, the exterior surface of hood 12, as well the exterior surface of rear housing member 24 (FIGS. 4 and 5) may be made of a material that enhances the aesthetic appeal of those components that are exposed to the end user. In that regard, those exterior surfaces may be made of the same stainless-steel material described above and that makes up the exterior surface of front panel 120 (FIG. 2), or they could alternatively be made of a different material. The use of a fingerprint-resistant coating for the outer surfaces of hood 12 and rear housing member 24 may, for example, also be desirable to prevent an otherwise poor appearance of the resulting dispensers upon continued contact with the hands of many users. It is contemplated, however, that the outer surfaces of hood 12, of rear housing member 24, and/or of front panel 120 may be made of other metallic or non-metallic materials, which may be desirable, for example, to minimize the cost of manufacture of those components.

From the above disclosure of the general principles of the present invention and the preceding detailed description of exemplifying embodiments, those skilled in the art will readily comprehend the various modifications to which this invention is susceptible. Accordingly, this invention is intended to be limited only by the scope of the following claims and equivalents thereof.

What is claimed is:

1. A paper product dispenser kit comprising:

a hood having a coupling component;

a first rear housing member configured for selective coupling with said hood, said first rear housing member having a first hood coupling component cooperating with said coupling component of said hood for releasably coupling said hood and said first rear housing member to one another, said first rear housing member and said hood jointly defining a first housing adapted to hold a roll of paper product therein;

a second rear housing member configured for selective coupling with said hood in place of said first rear housing member, said second rear housing member having a second hood coupling component cooperating with said coupling component of said hood for releasably coupling said hood and said second rear housing member to one another, said second rear housing member and said hood jointly defining a second housing adapted to hold a roll of paper product therein; and a dispensing member at least partially disposed within said first housing or said second housing and adapted to selectively dispense the paper product respectively from within said first housing or from within said second housing, wherein:

said first rear housing member has a first pair of oppositely located side walls, a first rear wall extending between said first pair of side walls, and at least one resilient side tab extending outwardly from one of said first pair of side walls and configured to engage one or both external side walls of a recessed space for mounting said first rear housing member within the recessed space, said first rear housing member further including a front opening and a front panel surrounding said front opening, and said second rear housing member has a second pair of oppositely located side walls, a second rear wall extending between said second pair of side walls, and a mounting feature on said second rear wall for mounting said second rear housing member on an external wall.

2. The dispenser kit of claim 1, wherein selective releasable coupling between said hood and said first rear housing member and between said hood and said second rear housing member is free of fasteners.

3. The dispenser kit of claim 1, wherein said coupling component of said hood includes a male coupling component and each of said first and second hood coupling components includes a respective female hood coupling component adapted to receive said male coupling component for selective releasable coupling between said hood and said first rear housing member and between said hood and said second rear housing member.

4. The dispenser kit of claim 3, wherein said male coupling component includes a resilient element for snap-coupling between said male coupling component and said respective female hood coupling components.

5. The dispenser kit of claim 4, wherein said snap-coupling includes said hood being locked in place relative to said first rear housing member or relative to said second rear housing member.

6. The dispenser kit of claim 1, further comprising a pair of roll support arms, each configured to support an end of a roll of paper product, each of said first and second rear housing members including a respective pair of roll support couplers, each configured for selective releasable coupling with said pair of roll support arms.

7. The dispenser kit of claim 6, wherein said respective pairs of roll support couplers include a female element and each of said pair of roll support arms includes a male element configured to be received within said female element.

8. The dispenser kit of claim 6, wherein coupling between said respective pairs of roll support couplers and said pair of roll support arms is free of fasteners.

9. The dispenser kit of claim 6, wherein each of said pair of roll support arms includes an arm resilient element, configured to flex upon coupling engagement between one of said roll support arms and a respective one of said roll support couplers.

10. The dispenser kit of claim 9, wherein said arm resilient element is configured to lock said roll support arm including said resilient element, relative to a corresponding roll support coupler to which said roll support arm is coupled.

11. The dispenser kit of claim 6, wherein each of said pair of roll support arms has a guide element configured to restrict the number of possible orientations of said roll support arm for coupling with one of said roll support couplers.

12. The dispenser kit of claim 1, wherein said dispensing member includes a paper feed bar and each of said first rear housing member and said second rear housing member includes a top wall and an oppositely disposed bottom wall, both extending between said first pair of side walls of said first rear housing member and between said second pair of side walls of said second rear housing member, respectively, said bottom wall including a notch defining an opening in said bottom wall adapted to allow said paper feed bar to extend there through and to an exterior of said first or second housing.

13. The dispenser kit of claim 12, further comprising a bottom console configured for selective releasable coupling with said bottom wall, said bottom console including a protruding portion configured to engage said notch so as to close said opening in said bottom wall.

14. The dispenser kit of claim 1, wherein said at least one resilient side tab includes a fastener opening, adapted to receive a fastener there through, for mounting said first rear housing member to the one or both external side walls.

15. The dispenser kit of claim 1, wherein at least one of said first pair of side walls includes an installation guide slot, adapted to permit viewing, from an interior of said first rear housing member, of an installation mark on an adjacent one of the external side walls.

16. The dispenser kit of claim 1, wherein said first rear housing member includes a top wall and an oppositely disposed bottom wall, both extending between said first pair of side walls, said first rear housing member including a bottom plate adjacent said bottom wall, said bottom plate having first and second bottom plate members slidable relative to one another, so as to permit adjustment of a depth dimension of said bottom plate.

17. The dispenser kit of claim 1, wherein each of said first and second rear walls of said first and second rear housing members, respectively, includes a wire hole adapted to receive a wire there through, for providing power to said dispensing member.

18. The dispenser kit of claim 1, wherein said dispensing member includes a sensor and a processor, said sensor being configured to sense the presence of a human body adjacent said sensor, said processor being configured to cause said dispensing member to dispense paper product in response to sensing by said sensor.

19. The dispenser kit of claim 1, wherein said dispensing member includes a paper feed bar, manually actuatable to cause the dispensing of paper product upon selective actuation thereof.

20. The dispenser kit of claim 1, wherein said hood has a metallic outer surface.

21. The dispenser kit of claim 1, wherein said first rear housing member includes a front opening and a metallic front panel surrounding said front opening.

22. The dispenser kit of claim 1, wherein said second rear housing member has a metallic outer surface.

23. The dispenser kit of claim 1, wherein said second rear housing member is free from resilient side tabs extending outwardly from either of said second pair of side walls.

24. A paper product dispenser kit comprising:

a hood having a metallic outer surface and a male coupling component;

a first rear housing member configured for selective coupling with said hood, said first rear housing member having a first female hood coupling component cooperating with said male coupling component of said hood for releasable, fastener-free coupling between said hood and said first rear housing member, said first rear housing member and said hood jointly defining a first housing adapted to hold a roll of paper product therein;

a second rear housing member having a metallic outer surface and configured for selective coupling with said hood in place of said first rear housing member, said second rear housing member having a second female hood coupling component cooperating with said male coupling component of said hood for releasable coupling between said hood and said second rear housing member, said second rear housing member and said hood jointly defining a second housing adapted to hold a roll of paper product therein; and a dispensing member at least partially disposed within said first housing or said second housing and adapted to selectively dispense the paper product respectively from within said first housing or from within said second housing, wherein:

said first rear housing member has a first pair of oppositely located side walls, a first rear wall extending between said first pair of side walls, at least one resilient side tab extending outwardly from each of said first pair of side walls, each of said resilient side tabs being configured to engage external side walls of a recessed space for mounting said first rear housing member within the recessed space, said first rear housing member further including a front opening and a metallic front panel surrounding said front opening of said first rear housing member, and said second rear housing member has a second pair of oppositely located side walls, a second rear wall extending between said second pair of side walls, and at least one fastener opening extending through said second rear wall for mounting said second rear housing member on an external wall.

25. A paper product dispenser kit comprising:

a hood having coupling means;

a first rear housing member configured for selective coupling with said hood, said first rear housing member having first hood coupling means cooperating with said coupling means of said hood for releasably coupling said hood and said first rear housing member to one another, said first rear housing member and said hood jointly defining a first housing adapted to hold a roll of paper product therein;

a second rear housing member configured for selective coupling with said hood in place of said first rear housing member, said second rear housing member having second hood coupling means cooperating with said coupling means of said hood for releasably coupling said hood and said second rear housing member to one another, said second rear housing member and said hood jointly defining a second housing adapted to hold a roll of paper product therein; and means at least partially disposed within said first housing or said second housing for selectively dispensing the paper product respectively from within said first housing or from within said second housing, wherein:

said first rear housing member has a first pair of oppositely located side walls, a first rear wall extending between said first pair of side walls, and resilient means extending outwardly from at least one of said first pair of side walls and configured to engage one or both external side walls of a recessed space for mounting said first rear housing member within the recessed space, said first rear housing member further including a front opening and a front panel surrounding said front opening, and said second rear housing member has a second pair of oppositely located side walls, a second rear wall extending between said second pair of side walls, and mounting means on said second rear wall for mounting said second rear housing member on an external wall.

26. The dispenser kit of claim 25, wherein said coupling means of said hood and said first hood coupling means define a fastener-free coupling between said hood and said first rear housing member.

27. The dispenser kit of claim 25, wherein said coupling means of said hood and said second hood coupling means define a fastener-free coupling between said hood and said second rear housing member.

28. The dispenser kit of claim 25, wherein said second rear housing member is free from resilient means extending outwardly from either of said second pair of side walls.

* * * * *